US005537138A

United States Patent [19]

Yamada et al.

[11] Patent Number: 5,537,138

[45] Date of Patent: Jul. 16, 1996

[54] RECORDING AND ERASING SYSTEM FOR THEMOREVERSIBLE RECORDING MEDIUM

[75] Inventors: Keiki Yamada; Masaru Ohnishi, both of Kamakura, Japan

[73] Assignee: Mitsubishi Denki Kabushiki Kaisha, Tokyo, Japan

[21] Appl. No.: 137,186

[22] PCT Filed: Feb. 8, 1993

[86] PCT No.: PCT/JP93/00160

§ 371 Date: Oct. 7, 1993

§ 102(e) Date: Oct. 7, 1993

[87] PCT Pub. No.: WO93/15912

PCT Pub. Date: Aug. 19, 1993

[30] Foreign Application Priority Data

| | | | |
|---|---|---|---|
| Feb. 7, 1992 | [JP] | Japan | 4-022573 |
| Feb. 13, 1992 | [JP] | Japan | 4-26964 |
| Apr. 13, 1992 | [JP] | Japan | 4-92780 |
| Jan. 28, 1993 | [JP] | Japan | 5-012697 |

[51] Int. Cl.[6] ..... B41J 2/325

[52] U.S. Cl. ..... 347/171

[58] Field of Search ..... 346/76 PH, 76 R, 346/135.1, 762, 108, 1.1; 359/43, 44; 347/171; 400/120.01

[56] References Cited

U.S. PATENT DOCUMENTS

| | | | |
|---|---|---|---|
| 4,851,924 | 7/1989 | Nakamura et al. | 346/76 PH |
| 4,965,528 | 9/1987 | Dabisch et al. | 430/290 |

FOREIGN PATENT DOCUMENTS

| | | |
|---|---|---|
| 0461606 | 12/1991 | European Pat. Off. . |
| 0468237 | 1/1992 | European Pat. Off. . |
| 48-86541 | 11/1973 | Japan . |
| 56-86777 | 7/1981 | Japan . |
| 57-117140 | 7/1982 | Japan . |
| 57-169371 | 10/1982 | Japan . |
| 60-7700 | 1/1985 | Japan . |
| 60-167128 | 8/1985 | Japan . |
| 61-105178 | 7/1986 | Japan . |
| 61-188855 | 11/1986 | Japan . |
| 1-208732 | 8/1989 | Japan . |
| 2-8958 | 1/1990 | Japan . |
| 0050897 | 2/1990 | Japan . |
| 2-188294 | 7/1990 | Japan . |
| WO90/11898 | 10/1990 | WIPO . |

*Primary Examiner*—Huan H. Tran
*Attorney, Agent, or Firm*—Wolf, Greenfield & Sacks

[57] ABSTRACT

The present invention relates to a recording and erasing system which uses a thermoreversible medium 1, which can be heated to a first temperature so as to make an image visible thereon, and can be heated to a second temperature so as to make the image invisible. Such a thermoreversible recording medium tends to carry residual images thereon reducing its thermoreversibility after repeated recording and erasing processes. To overcome this problem, the recording and erasing system includes an erasing data generator 7 for varying the energy applied to a heating element so that the recording medium can be heated to a predetermined temperature. The recording and erasing system has an element for checking the usability of the recording medium, thereby preventing use of unusable recording media.

15 Claims, 20 Drawing Sheets

| LINE DATA | 1 | 2 | 3 | 4 | 5 | 6 | | 29 | 30 | |
|---|---|---|---|---|---|---|---|---|---|---|
| VOLTAGE-SUPPLYING PULSE WIDTH ms | 11 | 10.8 | 10.8 | 10.7 | 10.7 | 10.6 | | 10 | 10 | |

| LINE DATA | 1 | 2 | 3 | 4 | 5 |
|---|---|---|---|---|---|
| VOLTAGE-SUPPLYING PULSE WIDTH ms | 1.5 | 10 | 10 | 10 | 10 |

| LINE DATA | 1 | 2 | 3 | 4 | 5 | 6 | 7 | 8 | 9 | --- |
|---|---|---|---|---|---|---|---|---|---|---|
| VOLTAGE - SUPPLYING PULSE WIDTH ms | 13 | 20 | 13 | 12 | 11 | 10 | 10 | 10 | 10 | --- |

| LINE DATA | 1 | 2 | 3 | 4 | 5 | 6 | 7 | 8 | 9 | --- |
|---|---|---|---|---|---|---|---|---|---|---|
| VOLTAGE - SUPPLYING PULSE WIDTH ms | 20 | 15 | 20 | 15 | 20 | 15 | 10 | 10 | 10 | --- |

| LINE COUNTER OUTPUT | 1 | 2 | 3 | 4 | 5 | | | 100 | 101 | | | 500 | 501 |
|---|---|---|---|---|---|---|---|---|---|---|---|---|---|
| VOLTAGE-SUPPLYING PULSE WIDTH ms | 20 | 20 | 20 | 20 | 20 | | | 19 | 19 | | | 18 | 18 |

RECORDING AND ERASING SYSTEM FOR THEMOREVERSIBLE RECORDING MEDIUM

FIELD OF THE INVENTION

This invention relates to a recording and erasing system which records an image on a thermoreversible recording medium and erases such a recorded image therefrom by controlling a quantity of energy applied thereto.

BACKGROUND OF THE INVENTION

Up to now, efforts have been made to develop recording systems which can repeatedly record and erase an image on and from a thermoreversible recording medium which becomes black, or transparent and colorless depending upon quantities of thermal energy applied thereto.

Japanese patent laid-open publications No. Sho 57-77140 and Hei 2-188294 propose examples of thermographic materials for such a recording medium.

The former publication exemplifies a thermoreversible recording medium comprising layers of thermoreversible material of a whitening group applied on the surface of a glass or plastic substrate. This material inverts its state at two transition temperatures $t_1$ and $t_2$ ($t_1 < t_2$). When heated above the temperature $t_2$ for a given period of time, the material becomes white. On the other hand, when heated above $t_1$ but below $t_2$ for a second given period of time, the material becomes transparent and colorless. Therefore, heating elements of a thermal head associated with an image to be recorded are heated above $t_2$, while heating elements associated with an image to be erased are heated above $t_1$ but under $t_2$.

The latter publication discloses a thermoreversible medium including a thermoreversible material of a dye group. When the recording medium contains a dye whose transparency or color changes with temperatures, the medium can be repeatedly used for recording and erasing images such as letters and symbols thereon and therefrom, respectively, similarly to the foregoing thermoreversible medium of the whitening group.

The principle of the recording system will be described hereinafter. When a first energy ($h_1$) is applied from a dynamic heat source such as a thermal head, the thermoreversible material is developed to form a first dark image (in black). The image is maintained as it is in a normal environment (temperature and humidity), but is erasable when a second energy ($h_2$) is applied thereto. When the first energy ($h_1$) is applied again, a second image can be formed. Thus, the recording and erasing can be performed repeatedly.

FIG. 1 of the accompanying drawings is a schematic view showing the configuration of the foregoing recording medium 1, which comprises a protective film 14, a recording layer 15 including materials such as a dye, an agent for making an image visible/invisible and a binder, and a substrate 16. When the first large energy ($h_1$) of 200° to 300° C. is applied onto the recording medium 1 for a short period of time, e.g. 1 to 3 ms, in the direction shown by an arrow A, a black image is formed on the recording medium 1, for example. Conversely, when the second small energy ($h_2$) of 80°–160° C. is applied to the recording medium 1 for a relatively long period of time, e.g. 5 ms to 2 sec, in the direction of the arrow A, the Image is erased from the recording medium.

Specifically, the recording layer 15 includes an agent for making the image visible/invisible which becomes acid and salt in response to an applied energy, and a leuco dye whose color changes with variations of acidity. FIG. 2 shows phenyl carbonate and organic amine salt as an example of the agent for making the image visible/invisible. FIG. 3 (*a*) shows a colorless leuco compound and FIG. 3 (*b*) shows a colored leuco compound.

The agent for making the image visible/invisible becomes acid when it is heated above the temperature $t_2$, so that lactone rings of the leuco dye are opened. Thus, the leuco dye becomes colored. When heated above the temperature $t_1$ but under the temperature $t_2$, the agent for making the image visible/invisible changes to alkaline, so that the opened lactone rings are closed. Therefore, the leuco dye becomes colorless.

This recording medium has characteristics as shown in FIGS. 4 and 5. In FIG. 4, the abscissa represents a period of time for voltage supply, and the ordinate represents a recording density. From FIG. 4, it can be seen that the recording medium has the maximum recording density of 1.2 when the recording medium is applied with a voltage for approximately 3 ms. In FIG. 5, the abscissa denotes an erasing temperature and the ordinate a recording density after erasure. In this case, the recording medium is applied with the voltage for 3 ms (i.e. the state where the recording medium has a recording density of 1.2) and is then heated by a heat roller, a thermal head or the like. FIG. 5 shows that the recording medium is completely free from an image near 120° C. to 150° C. (i.e. the state where the recording medium is similar to that having the density 0.15 prior to the recording).

The erasing characteristics are also shown in FIGS. 6 and 7, which are obtained in a different manner. FIG. 6 shows a completely black pattern 41 formed by the thermal head on the recording medium 1. FIG. 7 shows the erasing characteristic of the recording system which erases the black pattern of FIG. 6. An energy of 1.0 mJ/dot and an energy of 0.6 mj/dot are applied to the recording medium in the direction shown by an arrow B for the recording and erasing, respectively. Referring to FIG. 7, it can be seen that the erasing is not complete at the beginning of the erasing process (i.e. about the first to 30th lines in the black image) and substantially after the 300th and succeeding lines of the black image.

The head portion of the recorded image is not erased because the thermal head does not reach its effective temperature. This is because heating elements of the thermal head take a certain period of time to become effective even when thermal head is left at room temperature (without applying a voltage thereto for a while) and is heated under such a condition. The thermal head is not elevated to its effective temperature until the tenth line is being erased. In other words, the thermal head is unstable in its operation until it is sufficiently activated.

The reason why the image is not erased in a portion following a 300th line is that the heating elements become too hot in the heated thermal head. Two kinds of energy are reserved in the thermal head. One is a part of the energy generated by the heating elements and the other is the energy which is used to erase a previous line and both energies remain accumulated around the heating elements. Both of these energies raise the temperature of the heating elements which are repeatedly heated for every line. Thus, the thermal head becomes too hot to erase the recorded image.

FIG. 8 shows a comparison of erasing characteristics on a large recording medium of A4 size and a small recording medium of a card size. In FIG. 8, the ordinate represents the numerical order of a line to be erased, and the abscissa represents an erasing temperature. The larger the recording medium, the more incomplete the erasure.

The conventional recording and erasing system for the thermoreversible recording medium adopts a method in which energies are applied to the recorded image so as to make it invisible. In other words, the recorded image to be erased is heated at the temperature which is above $t_1$ but under $t_2$ as mentioned above.

As described so far, the thermoreversible recording medium tends to vary its reflectance and recording density somewhat depending upon its recording and erasing history. In other words, the recording medium shows different degress of reflectance and recording densities at the recorded and erased areas and at the areas which have never been recorded and erased. Therefore, incompletely erased images sometimes remain vaguely on the recording medium in a manner such that they are faintly visible. Prior art recording and erasing systems suffer from the problem that erasure is somewhat incomplete.

Furthermore, there are few recording mediums which are completely thermoreversible. Usually, the more often they are used, the poorer they become, and finally they will become unusable. During repeated use, the recording medium extensively undergoes physical and chemical changes so that it may become worn out. Furthermore, the recording medium may have its protective film and thermoreversible film damaged by heat and pressure applied thereto via the thermal head as a heating means. Therefore, the user has to determine whether or not the recording medium in use is still usable, and remove the unusable recording medium. If such a unusable recording medium is continuously used since the user is not aware of its reduced performance, either recording or erasing cannot be carried out thereon, which will be inconvenient to the user.

Such determination on the performance of the recording medium will be troublesome to the user. Sometimes, the user might throw away a still usable recording medium, or recording might be performed to no avail on an unusable recording medium.

SUMMARY OF THE INVENTION

This invention is intended to overcome the foregoing problems encountered with prior art systems. It is an object of the invention to provide a recording and erasing system which can erase a previous image from a recording medium so that it is remarkably indistinct, and which can Identify a used-up recording medium.

According to a first aspect of the invention, when erasing an image, the recording and erasing system does not apply a uniform energy quantities to the image but varies energy quantities to the image. Specifically, greater energy is applied to the head portion of the image since a thermal head is not hot enough at the initial stage of the erasing. Further, quantities of energy are variable for each line of the image so that the image is erased in an optimum manner.

At the time of erasing, energy is applied to a larger area of the recording medium than at the time of recording. Therefore, the thermal head can be sufficiently heated before it comes into contact with the image area to be erased, which enables the image to be sufficiently erased in the advancing direction and lateral direction of the recording medium. This is because energy tends to leak at the opposite side edges of the recording medium. Further, the image can be sufficiently erased even when there is a positional displacement of the recorded area and the area to be heated for the erasing.

According to a second aspect, the recording and erasing system includes a background pattern generating means. The background pattern generating means generates a background pattern on the entire or a preset area of the recording medium. The image is then erased from the recording medium. When there is a residual background pattern on the recording medium, it will make the previous image less identifiable.

The recording and erasing system includes a heating means which can concurrently be used for the recording and the erasing. The heating means applies a first energy to an erasing portion and a second energy to a recording portion. Energies are also applied to areas of the recording medium where no image is recorded, so that the recording medium has a substantially uniform reflectance after its repeated use, and the residual image is made further unidentifiable.

According to a third aspect of the invention, the recording and erasing system includes a means for recording on the thermoreversible reusable recording medium the number of times it has been used, a reading means for reading the recorded data, and a writing means for writing a current number of times of use. The recording and erasing system also includes a means for determining whether the recording medium is still usable, and a means for sorting usable and unusable recording mediums based on the data from the determining means.

The recording and erasing system further includes a means for writing on the recording medium a message indicating that the recording medium is unusable, according to the result of the determining means.

The recording and erasing system includes a feeder for supplying a new recording medium when an unusable recording medium is loaded or when a new recording medium is required.

A display unit is included in the recording and erasing system so that the result of the determining means can be indicated.

A data memory is included in the recording and erasing system so as to store data recorded on the recording medium.

As described so far, the number of times of use is recorded on the recording medium. Therefore, the recording medium is checked as for its usability based on the number-of-times-use data thereon. When the recording medium is found to be unusable, it is recorded with the message to notify the user of this fact. In such a case, a new recording medium will be produced, and necessary data will be recorded thereon. The number of times of use and unusabe state of the recording medium will be given on the display. Further, the data memory stores the data recorded on the recording medium.

According to the invention, it is possible to minimize residual images which are caused by performances of the thermal head, a positional displacement of areas of the image to be heated for the recording and the erasing, and so forth.

Further, it is possible to make residual images, resulting from repeated use of the recording medium, less identifiable.

The recording medium which is used up to its limit is separated, so that the used-up recording medium will not be reused.

BRIEF DESCRIPTION OF THE DRAWINGS

The principles of the present invention are shown FIGS. 1 to 8.

DETAILED DESCRIPTION OF PREFERRED EMBODIMENTS

Figure 1:
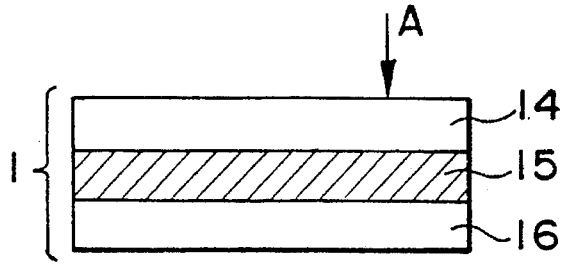
FIG. 1 shows the configuration of a thermoreversible recording medium 1 in film shape.
Figure 2:
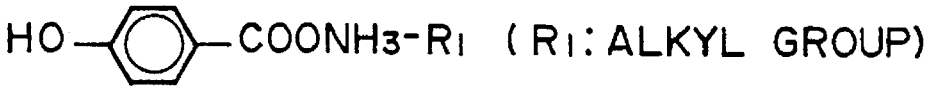
FIG. 2 shows the structure of an agent for making an image visible/invisible constituting the thermoreversible recording medium.
Figure 3:
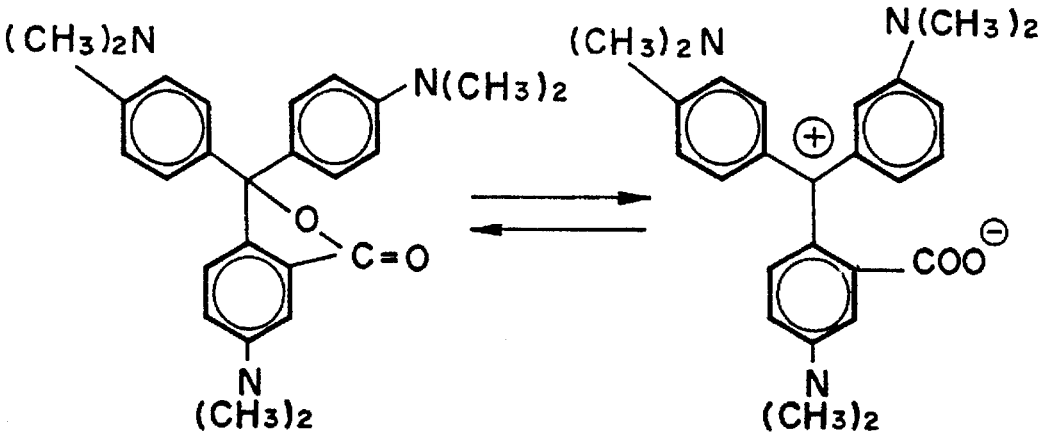
FIG. 3 shows the structure of dye used for the recording medium.
Figure 4:
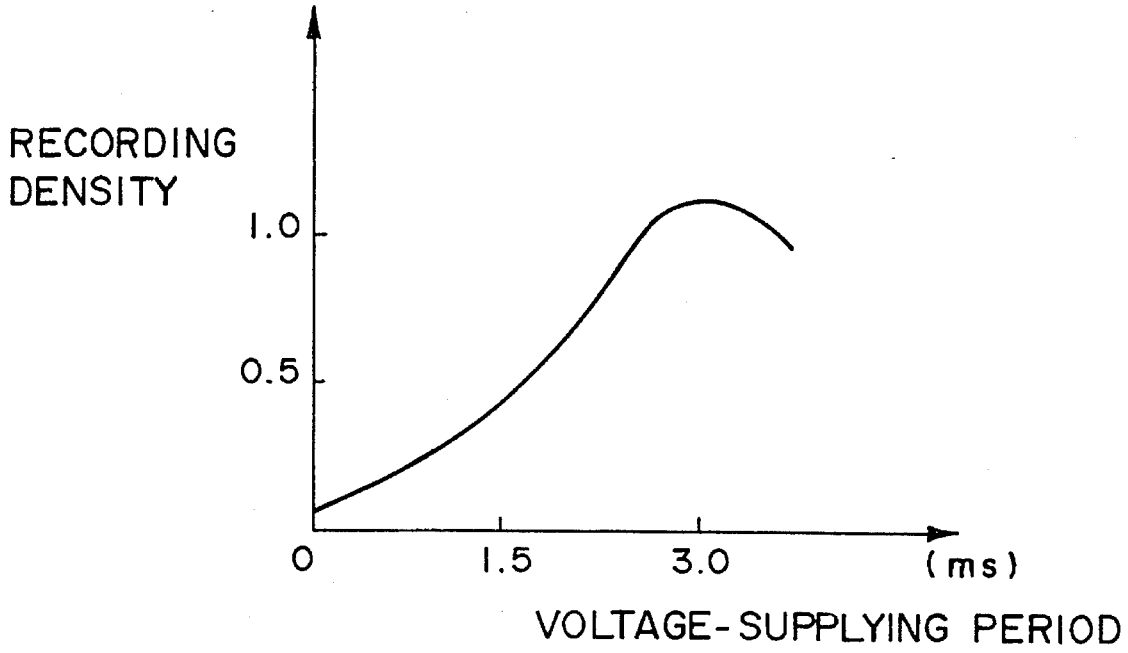
FIG. 4 is a graph showing the relationship between a recording density and a voltage-supplying period.
Figure 5:
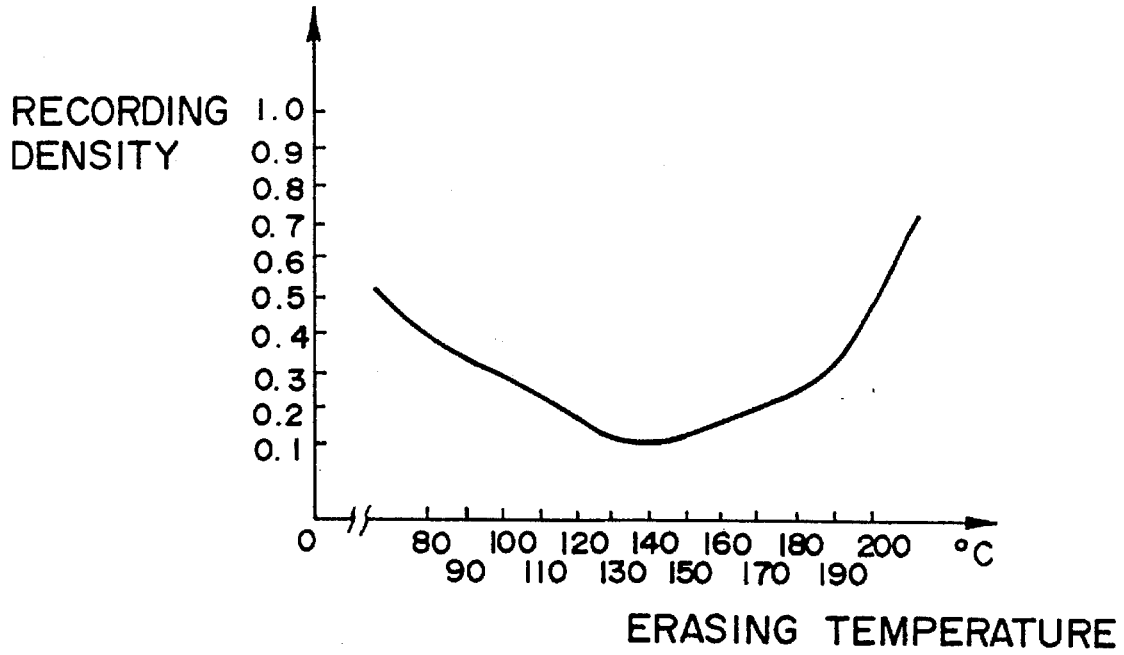
FIG. 5 is a graph similar to FIG. 4.

The invention will be described hereinafter with reference to preferred embodiments shown in the drawing figures.

EMBODIMENT 1

Figure 9:
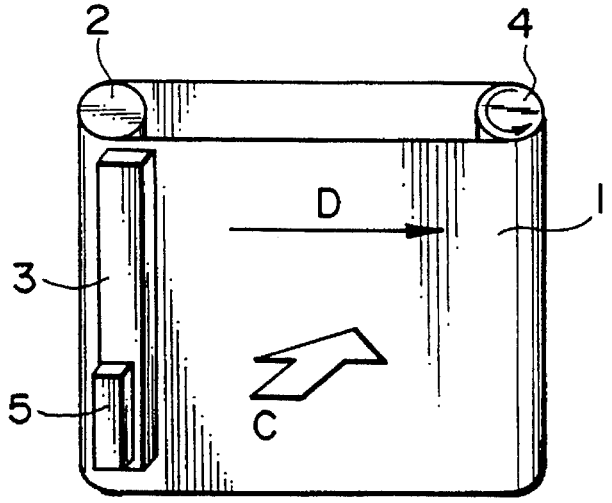
FIG. 9 is a schematic view of a recording and erasing system according to an embodiment of the present invention.

The recording and erasing system of the invention has the structure as shown in FIG. 9. The recording and erasing system is applicable to devices such as an information display, an electronic board and a message board used in a railway station. A thermoreversible recording medium 1 is repeatedly used for the recording and erasing processes, and is in the shape of a film in this embodiment. The recording medium 1 extends around supports 2 and 4 in a manner such that one image area thereof is visible in the direction shown by an arrow C. The supports 2 and 4 are made of material like rubber, and are rotated either clockwise or counterclockwise by a drive source such as a motor, not shown. A heating means 3 comes into contact with the support 2 so as to heat the recording medium 1, thereby perform the recording or erasing thereon. The heating means 3 comprises a thermal head, and has a size substantially equal to the width of the recording medium 1. For instance, when a visible area of the recording medium 1 is approximately of A4 size, the heating means 3 includes approximately 2,500 heating elements (not shown). A control means 5 controls the recording and erasing operations.

In operation, the recording and erasing system records an image based on data which are read by a word processor, a scanner or the like, and are transferred to the control means 5. Specifically, the control unit 5 sequentially transfers the image data to the thermal head 3, so that a voltage is applied to the heating elements for a given period of time. When heated, the heating elements provide the recording medium 1 with joule heat. Under this condition, the generated energy has a sufficiently high temperature so that the recording medium is elevated to a temperature above the second transition temperature mentioned above. Thereafter, the recording medium 1 is developed based on the image data. Then, the developed recording medium 1 is fed by one line in the direction D by a means such as a motor (not shown). Thereafter, the foregoing operation is repeated so as to record the image on the recording medium.

To erase the recorded image, the data which are the same as those for the recording will be supplied to the thermal head 3 from the control unit 5 or from an external unit (not shown) so that the thermal head 3 is supplied with voltage and heated for a given period of time. In this case, the energy to be applied has a temperature above the first transition temperature $t_1$ but below the temperature $t_2$. Thus, one line of the image is erased. This erasing process is repeated until the entire image is erased.

The foregoing describes the basic recording and erasing operations. The control unit 5 plays a very important role in the recording and erasing system, and has the configuration as shown in detail in FIG. 10. An input terminal 6 receives image data from an external source, not shown. An erase data generating unit 7 outputs a signal, e.g. "1", so as to heat heating elements of the thermal head. A selector 8 supplies either the Image or erasing data to a voltage supply control unit 9 (to be described later). In this embodiment, the control unit 5 prepares erasing data therein. When the erasing data are supplied from the external source (not shown), both the erasing data generating unit 7 and the selector 8 will be dispensable. The voltage supply control unit 9 control clock pulses, latch pulses, voltage-supplying pulses, voltages and so on to be applied to the thermal head 3. A CPU 10 not only controls the control unit 5 but also transfers data on voltage-supplying pulse width or applied voltage to the voltage supply control unit 9. A ROM 11 stores programs for the control unit 5 and data on the voltage-supplying pulse width or applied voltage.

Figures 10, 11:
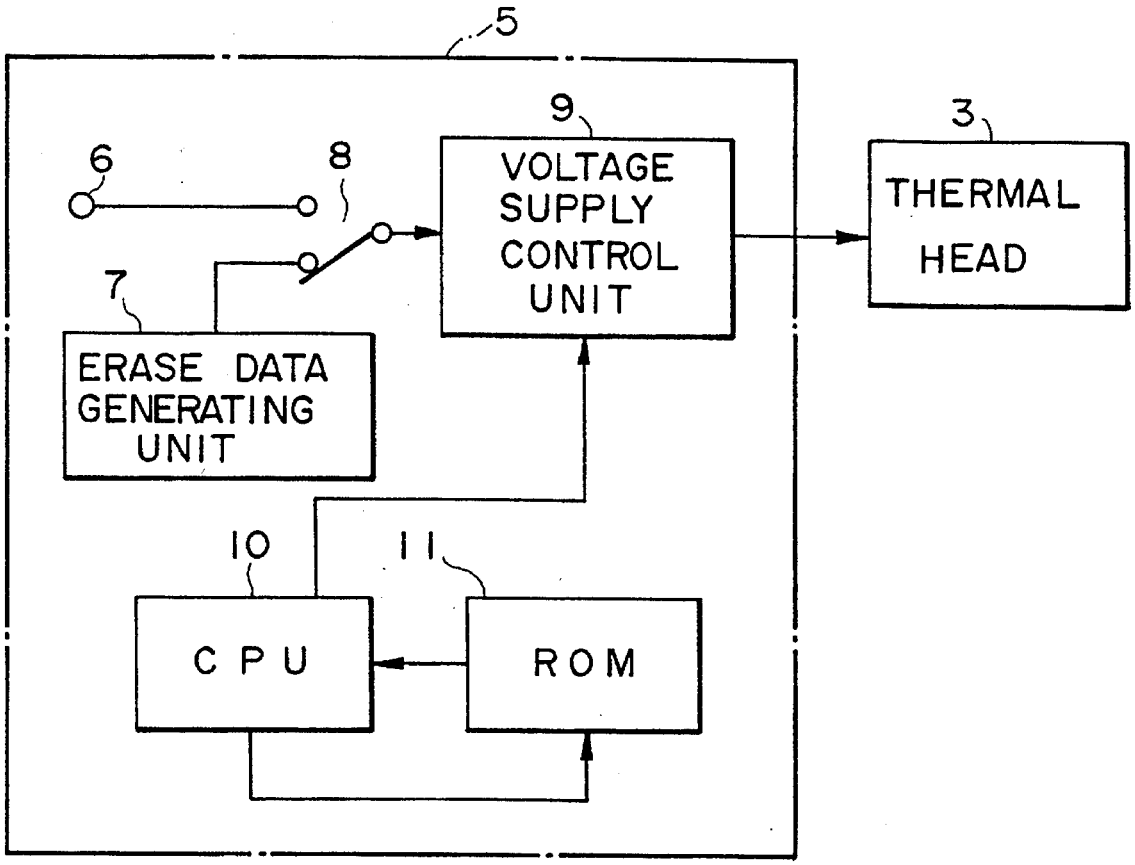
FIG. 10 shows the configuration of a control unit 5.
FIG. 11 shows a first example of a line data and voltage-supplying pulse width table.

To erase the recorded image, the selector 8 is set to a portion (FIG. 10) so as to transfer the erasing data to the voltage supply control unit 9 from the erasing data generating unit 7. Simultaneously, the CPU 10 designates an address in the ROM 11, so that data on the voltage-supplying pulse or applied voltage are transferred to the voltage-supplying control unit 9, which controls the thermal head 3 based on the received data. The ROM 11 has a table as shown in FIG. 11. To control the thermal head based on the voltage-supplying pulse width, the CPU 11 outputs voltage-supplying pulse width data associated with the address data (line data). The CPU 11 controls the thermal head based on an applied voltage in the similar manner. Further, it is possible to perform the foregoing control based on both the voltage-supplying pulse width and the applied voltage.

In the table of FIG. 11, the width of the voltage-supplying pulse is gradually reduced from the first line and so on. The 30th and succeeding lines have the pulse width of 10 ms. A position away from the first line to increase the pulse width depends upon characteristics of the thermal head 3, and heat radiating performance of members around the thermal head 3. It is remarkably effective to apply greater energy to the first line of the image to be erased. In such a case, it is preferable to apply to the first line an energy which is 1.1 to 1.5 times as large as that applied to the remaining lines of the image. In this case, the foregoing heat radiating characteristics affect the determination of which line should be applied with greater energy.

EMBODIMENT 2

Figures 12, 13:
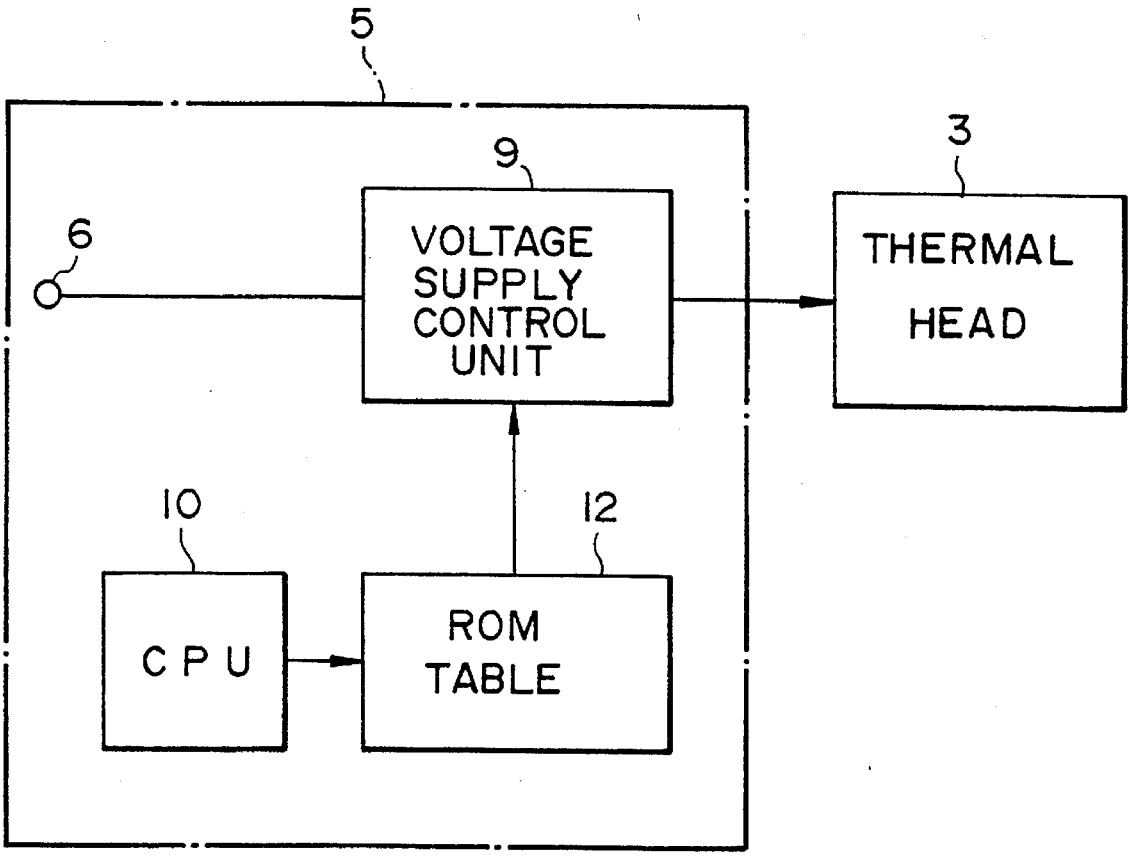
FIG. 12 shows a second example of a line data and voltage-supplying pulse width table.
FIG. 13 shows the configuration of another control unit 5.
Figure 14:
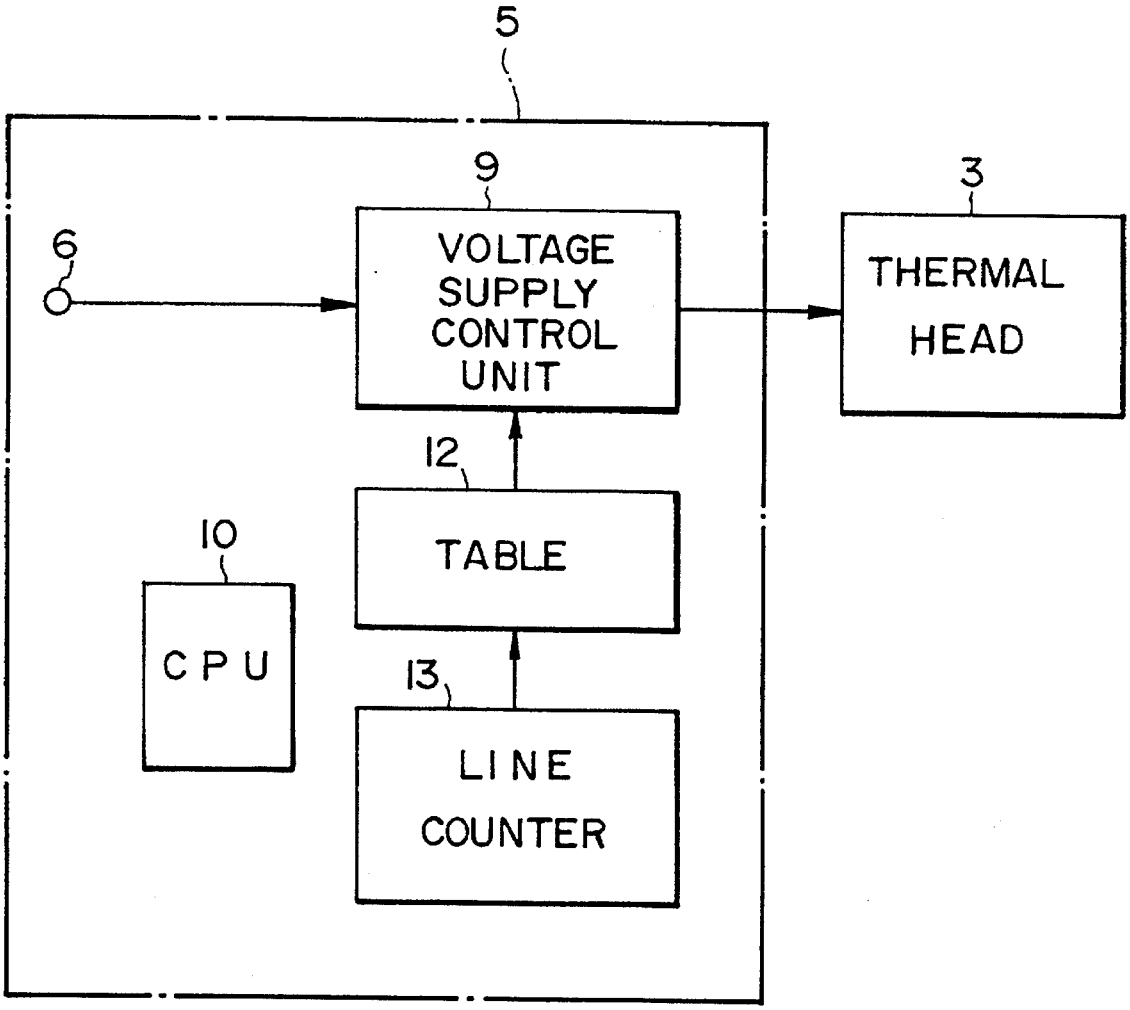
FIG. 14 shows the configuration of a further control unit 5.
Figure 15:
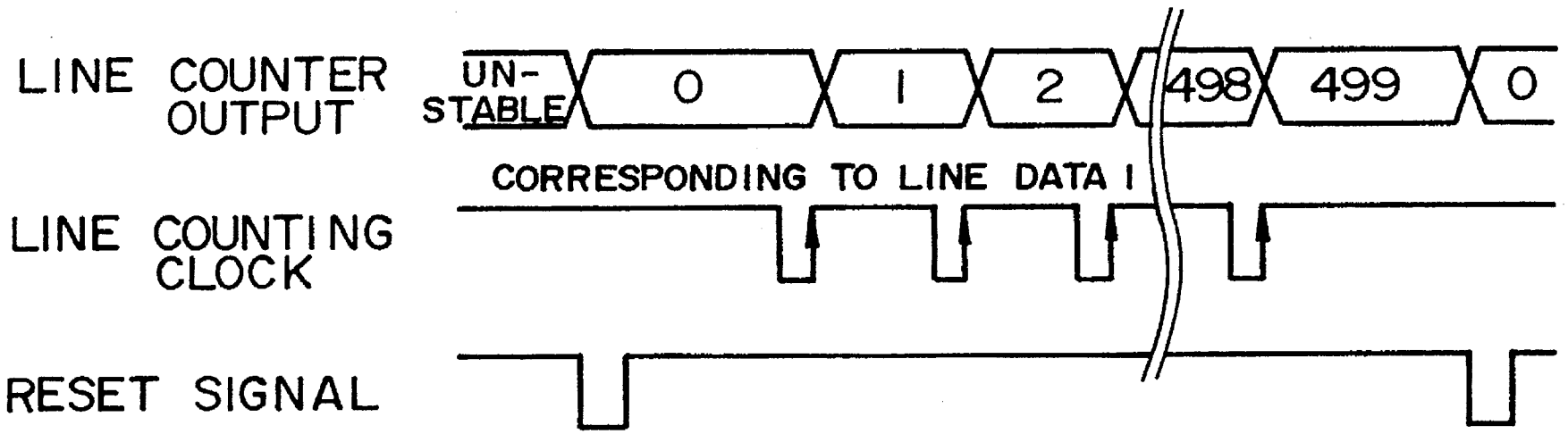
FIG. 15 is a timing chart showing the operation of the control unit of FIG. 14.

In the embodiment 1, the ROM 11 stores the operation sequence program and the data on the voltage-supplying pulse width or data on the voltage to be applied. In response to the designated address, the ROM 11 provides the CPU 10 with the program and the forgoing data. Then, the CPU 10 transfers the data to the voltage supply control unit 9. Alternatively, a ROM table 12 is provided for storing only the data on the voltage-supplying pulse width and a voltage to be applied as shown in FIG. 13. In response to the address designated by the CPU 10, the ROM 12 directly transfers the foregoing data to the voltage supply control unit 9.

EMBODIMENT 3

It is acceptable to connect an output of a line counter 13 to the ROM table 12 so that the ROM table 12 outputs the data to the voltage supply control unit 9. In this case, the CPU does not designate the address. The line counter 13 receives data such as a reset signal and a clock signal, and outputs line data. In operation, prior to the erasing, the output of the line counter 13 is cleared to "0" by the reset signal. The line counter 13 is incremented by one (1) by a clock signal each time one line is erased. When the lines are erased as required, another reset signal is resupplied to the line counter 13 so as to clear its output to 37 0". The line counter 13 repeats this operation. The output "0" of the line counter 13 represents the first line in the line data. Specifically, when the ROM table 12 has the contents as shown in FIG. 12, a pulse having a 15-ms width for the first line is applied to the thermal head 3. For the second and succeeding lines, pulses of a 10-ms-width are applied to the thermal head 3.

EMBODIMENT 4

Figures 16, 17, 18:
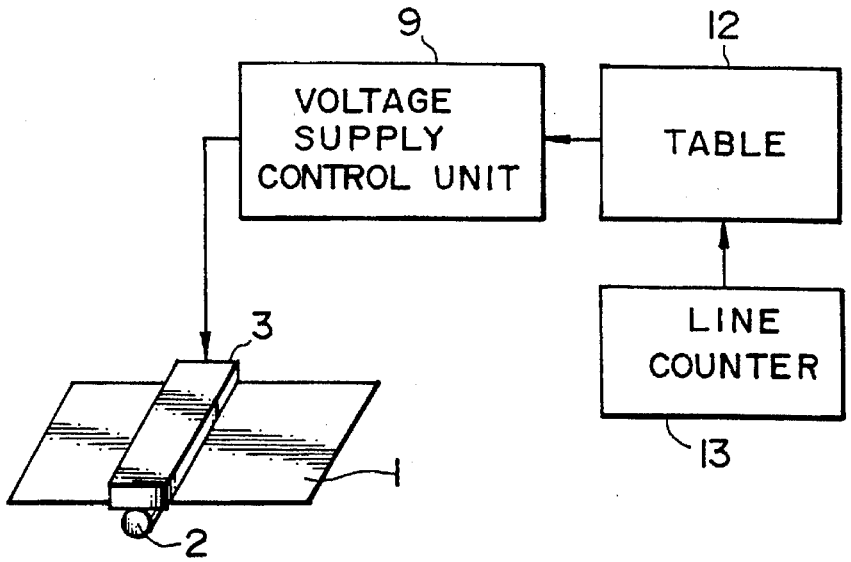
FIG. 16 shows a third example of a line data and voltage-supplying pulse width table.
FIG. 17 shows a fourth example of a line information and current-supplying pulse table.
FIG. 18 shows the configuration of a recording and erasing system according to another embodiment of the invention.

It is also conceivable for the CPU 10 to calculate the voltage-supplying pulse width or voltage to be applied and to output data on these items without the provision of the ROM table. In this case, an empirical formula is derived from experiment data so as to calculate the voltage-supplying pulse width of voltage to be applied. Further, the values shown on the table may be stored in either a combination circuit or a sequential circuit instead of the ROM or RAM. A number of variations are possible without departing from the scope of this application. As shown in FIG. 16, the voltage-supplying pulse of the first line may be smaller in width than that of the second line. This measure is sometimes taken when there is no image to be erased in the first line but an energy is applied just for convenience. Conversely, even when there is an image portion to be erased in the first line, the energy applied in 1.3 ms is larger the energy applied in 10 ms for the sixth and succeeding lines, so that the image portion can be erased substantially completely. As shown in FIG. 17, voltage-supplying pulses having the widths of 20 ms and 15 ms may be alternately applied. Application of such pulses is effective to stabilize the temperature at the leading edge of the recording medium, so that substantially complete erasing can be accomplished.

In this embodiment, the pulses are controlled with respect to their widths when they are applied to the thermal head 3. Alternatively, the similar effect can be attained by controlling the number of pulses applied to the thermal head. Specifically, the number of pulses for respective lines is stored in the ROM table 12. The voltage supply control unit 9 controls pulses so that they are applied to the thermal head 3 according to the preset number.

EMBODIMENT 5

FIG. 18 is a schematic view of the recording and erasing system according to a fifth embodiment of the invention. The recording and erasing system may be applied to make a record of the balance on a prepaid card, for example. The recording and erasing system comprises a reusable recording medium 1, a support 2 serving as a platen roller, a thermal head 3 as long as the width of the recording medium 1, a voltage supply control unit 9, a ROM table 12, and a line counter 13, all of which function similarly to those mentioned in the foregoing embodiments.

This embodiment is characterized in that energy to be applied is controlled by checking at least the numerical order of a line to be erased. A recorded image is erased by applying energy in the same manner as that for recording an image. Otherwise, the recorded image is erased by applying energy as if a complete black image is recorded. In the former case, the recorded image is stored in the memory beforehand, and energies different from those for the recording are applied to the thermal head 3. Alternatively, erasing data are transferred to the thermal head 3 from the external source as is done when recording an image. For this purpose, the recording medium has to be very precisely advanced so as to minimize non-erased image portions. This is because the erasure should be carried out in complete agreement with the recorded image. In the latter case, the erase data are set to "1" so that the thermal head 3 can be heated by the energy for the erasure.

Figure 6:
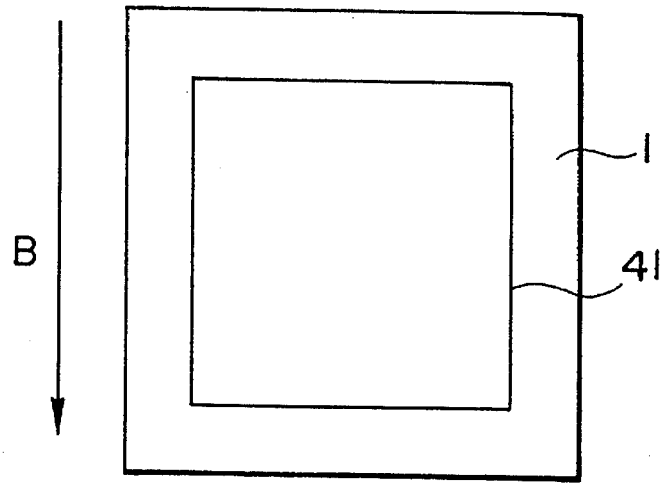
FIG. 6 shows an area to be heated for recording and erasing processes on the recording medium.
Figure 7:
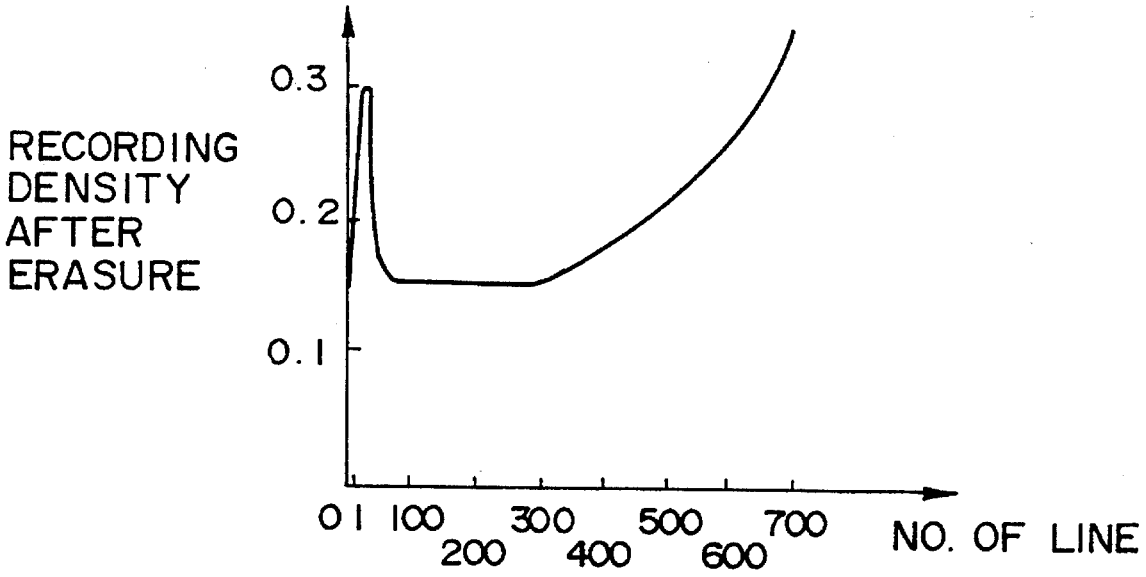
FIG. 7 is a graph showing recording densities of respective lines after the erasing process.
Figure 8:
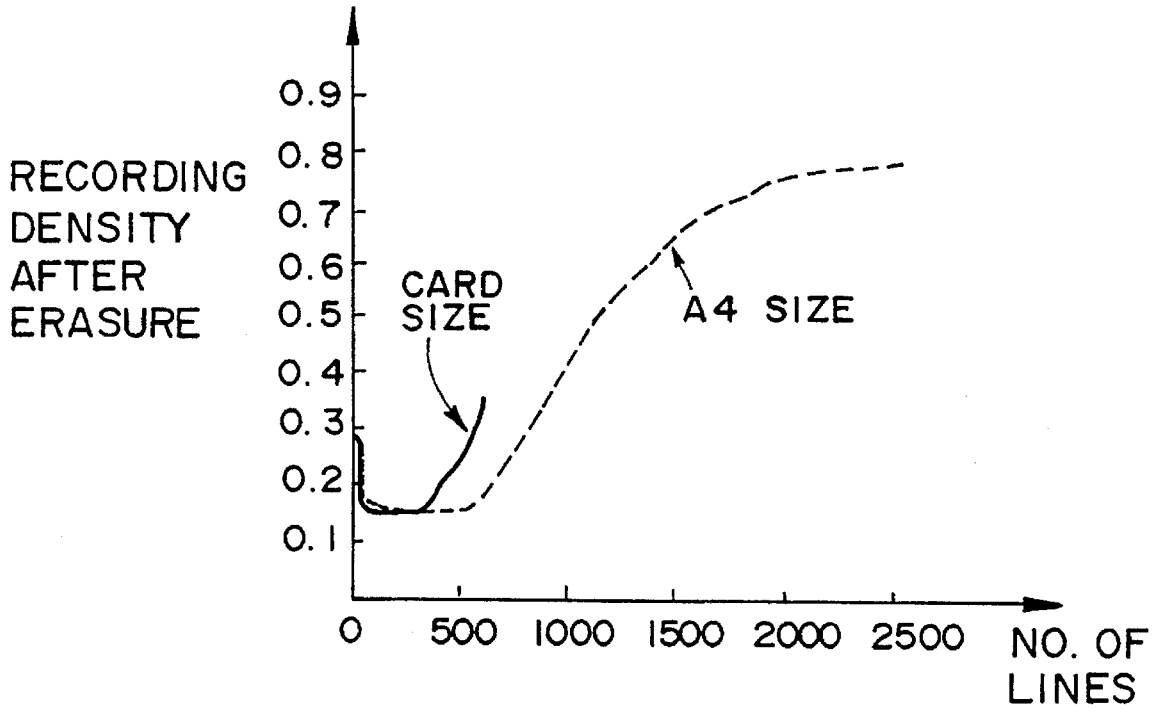
FIG. 8 is a graph showing recording densities of respective erased lines.

The erasing process using the all-black pattern (FIG. 6) will be carried out as follows regardless of the type of image to be erased. In this case, the thermal head 3 is heated so as to apply a lower energy (second energy $h_2$) than the recording energy to the recording medium. As described with reference to FIG. 7, the longer the thermal head 3 is heated, the more Incompletely the image will be erased because of energy accumulated in the heating elements. The present invention is aimed at overcoming this problem. The recording and erasing system includes at least a line counter 13 for checking the numerical order of a line to be erased. Based on an output from the line counter 13, energy to the thermal head 3 is gradually reduced. In this embodiment, the thermal head 3 is not selectively but continuously heated for the all-black image pattern. Therefore, it is possible to reliably know the temperature increase of the thermal head 3 by checking the numerical order of a line to be erased. At least the line counter 13 and the voltage supply control unit 9 suffice for precise and reliable erasure.

Figures 19, 20:
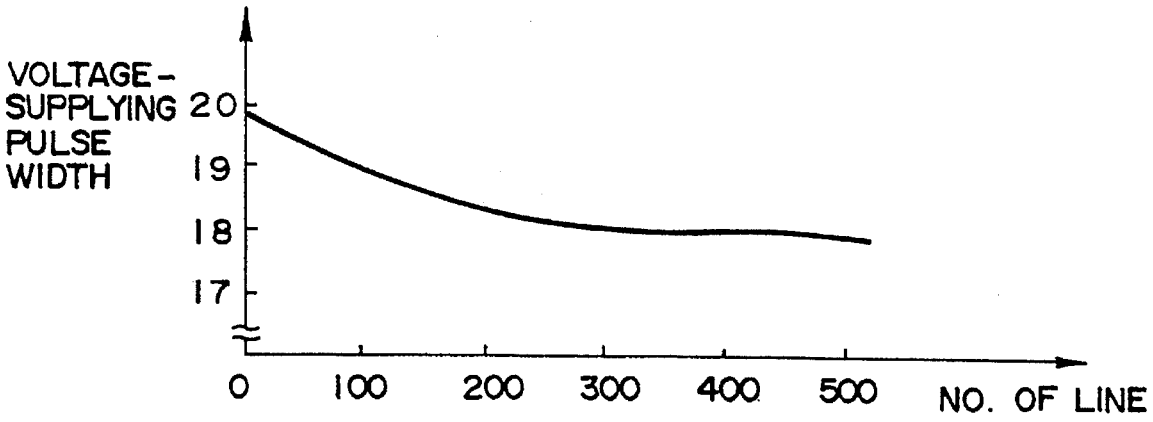
FIG. 19 shows a fifth example of a line data and voltage-supplying pulse width table.
FIG. 20 is a graph showing the relationship between an voltage-supplying pulse width and the number of lines.

Specifically, FIG. 19 is the ROM table 12 showing the contents thereof, i.e. correspondence of the line data and the voltage-supplying pulse width which are output of the line counter. This table can be easily prepared through experiments or calculation. For example, the temperature of the thermal head 3 is designed to be within the erasing temperature range of the reusable recording medium 1 as shown in FIG. 20. The line counter 13 checks the numerical order of a line to be erased, which corresponds to a period of time after heating the thermal head 3, or positional data (i.e. distance). The foregoing period of time or positional data can also be derived by performing calculations in terms of the erasing cycle or the extent to which the motor is rotated.

To reduce the memory capacity or make the circuitry compact, the contents of the ROM table 12 may be determined for every plurality of lines.

EMBODIMENT 6

A sixth embodiment of the invention will be described hereinafter. Insufficiently erased portions will be left if the image to be erased is in complete agreement with the recorded image. This phenomenon is caused by a number of factors. One of them is a positional shift between the recording medium carrying the image to be erased and the thermal head. Peripheral areas of the image are often left indistinctly visible. To overcome this positional shift, the recording medium should be moved in a precise relationship with the thermal head, which inevitably makes the recording and erasing system very expensive.

A second factor is that since the thermal head takes time to become hot, the leading edge of the recording medium is not sufficiently heated at the initial stage.

A third factor is that energy tends to leak from the opposite side edges of the recording medium, which are slow to become hot.

Figure 21:
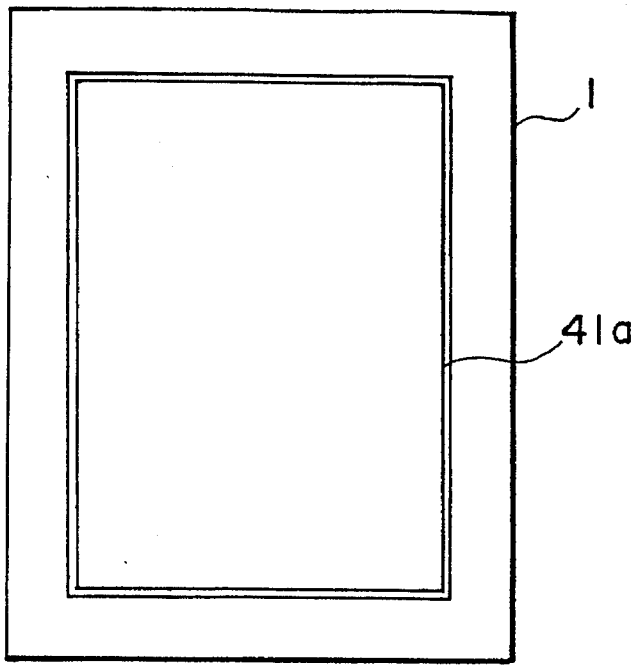
FIG. 21 shows a non-erased portion of a recorded image on the recording medium 1.

The trailing edge of the image is sometimes left incompletely erased because of energy accumulated in the thermal head. The peripheral edge 41*a* of the recorded image tends to be left non-erased as shown in FIG. 21. It is also an object of the invention to provide a recording and erasing system which can overcome this problem inexpensively and reliably.

Figure 22:
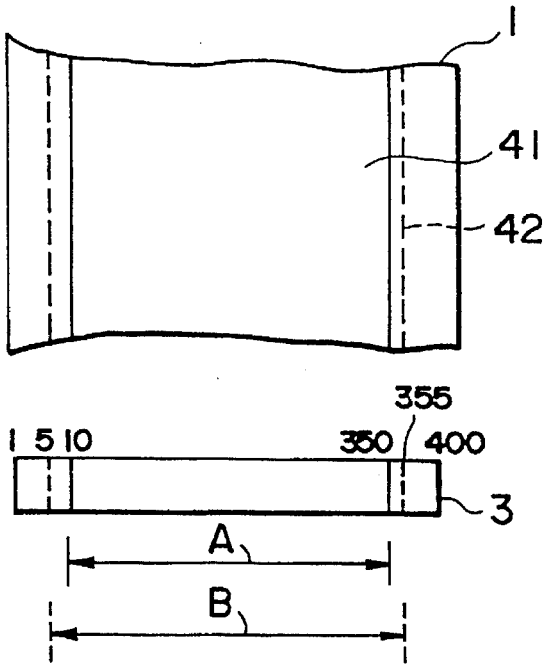
FIG. 22 shows a recorded area and an area to be erased.

The thermal head 3 is used for the erasure as in the foregoing embodiments. To erase the opposite side edges of the image completely, more heating elements are used than those for the recording. Specifically, when the thermal head 3 has 400 heating elements, the tenth to 350th heating elements (in the area A in FIG. 22) are selectively heated so as to form an image. To erase the image, the fifth to 355th heating elements are heated (in the area B in FIG. 22). Thus, the erase area 42 of the image is wider than the recorded image area 41 across the recording medium. When the ninth to 351st heating elements are heated to erase the image, i.e. one heating element is increased on each side edge of the image, the image can be erased to a sufficient extent. To erase the image perfectly, it is preferable to heat three or more heating elements beyond each side edge of the image. The number of heating elements to be heated depends upon the performance of the thermal head to be used, and is not limited to the above-mentioned values. Furthermore, it is also possible to vary the number of heating elements, e.g. one heating element on the right side and two heating elements on the left side.

Figure 23:
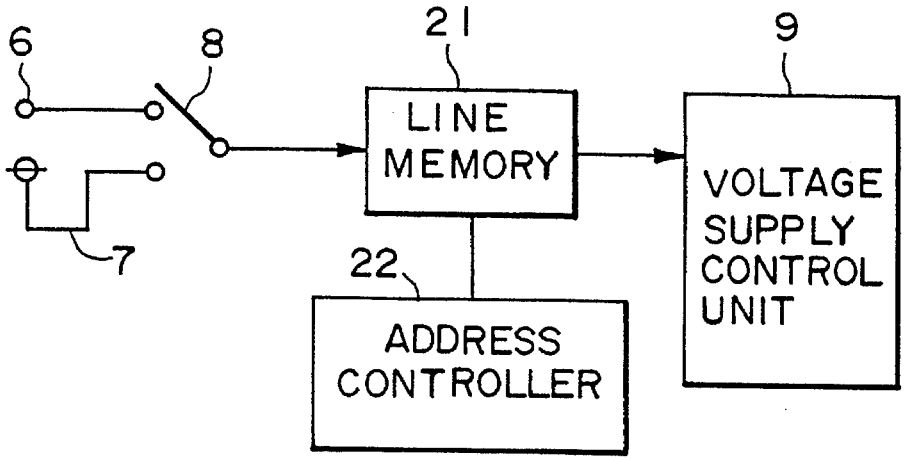
FIG. 23 shows the configuration of means for generating erasing data.
Figure 24:
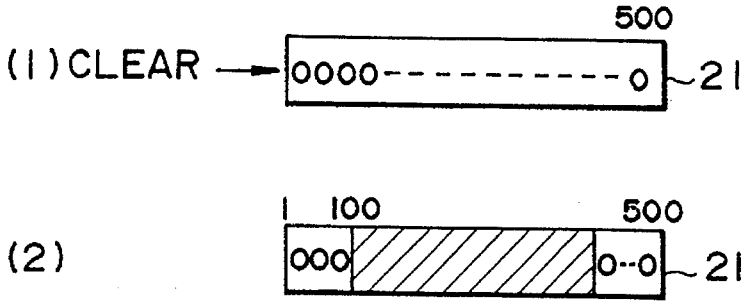
FIG. 24 shows the manner in which a heating head is controlled so that an area wider than the recorded area is heated for the erasure.

The recording and erasing system of this embodiment has the configuration as shown in FIG. 23. The unit for preparing data to be input to the thermal head 3 comprises an input terminal 6, an erasing data generating unit 7 for issuing a "1" signal to heat the thermal head 3, a selector 8, a line memory 21, and an address control unit 22 for the line memory 21. An output from the line memory 21 is supplied to a voltage supply control unit 9. In operation, recording data are input to the input terminal 6 from an external source, and are transferred to the line memory 21 via the selector 8. In this case, the address control unit 22 determines an address to be input. Specifically, referring to FIG. 24, the address control unit 22 clears the line memory which is capable of storing 500 data (i.e. emits the signal "0" denoting non-heating). Next, the address control unit 22 sets an address 100 to be output, inputs the recording data, increments the input data, stores the recording data in the manner as shown in FIG. 24 (2), and transfers the recording data corresponding to the address 1 and succeeding addresses to the voltage supply control unit 9 in succession.

To erase the recorded image, the selector 8 is set to its lower position, the line memory 21 is cleared, the address control unit 22 generates a value (i.e. 99 in this case) by subtracting one (1) from the address to which the head of the recording data are input, and the data corresponding to the signal "1" is sequentially stored in the line memory for the 99th and succeeding lines. The line memory stores the data "1" up to the end address +1 of the recording data. Therefore, the recording width +2 is equal to the erasing width. In this embodiment, the area to be erased varies with the recording data. Alternatively, it is possible to determine the erasing area to be invariable. In such a case, since it is not necessary to derive an address from the recorded data, the foregoing mechanism will be simplified. For instance, the erasing data generating unit 7 and selector 8 may be dispensed with, so that the data on the signal "1" may be stored during the erasure. Further, both the line memory 21 and the address control unit 22 may be dispensed with, and the selector 8 is operated to select either the recording data from the input terminal 6 or the erasing data from the erasing data generating unit 7, so that the number of heating elements to be heated for the erasing is greater than the number of heating elements to be heated for the recording. Alternatively, heating means are separately provided for the recording and erasing. This arrangement is also as effective as those mentioned above. The erasing data from the input terminal 6 are generated so that the erasing area is larger than the recorded area.

Figure 25:
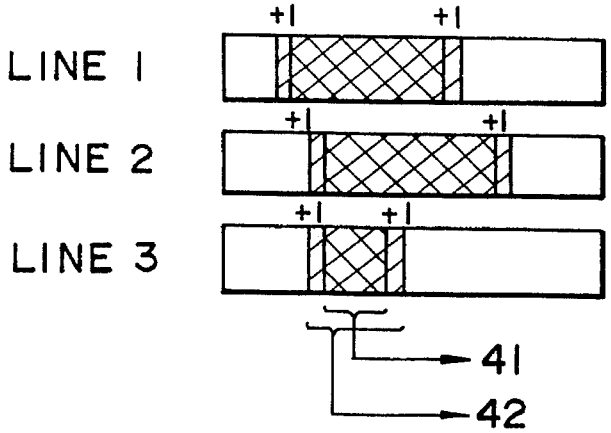
FIG. 25 shows a further example of how to control the thermal head so that an area wider than the recorded area is heated for the erasure.
Figure 26:
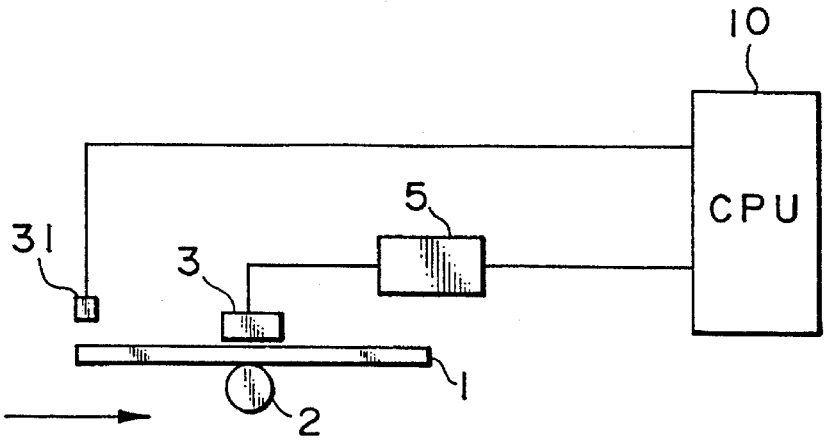
FIG. 26 shows the configuration of a recording and erasing system according to a further embodiment of the invention.
Figure 27:
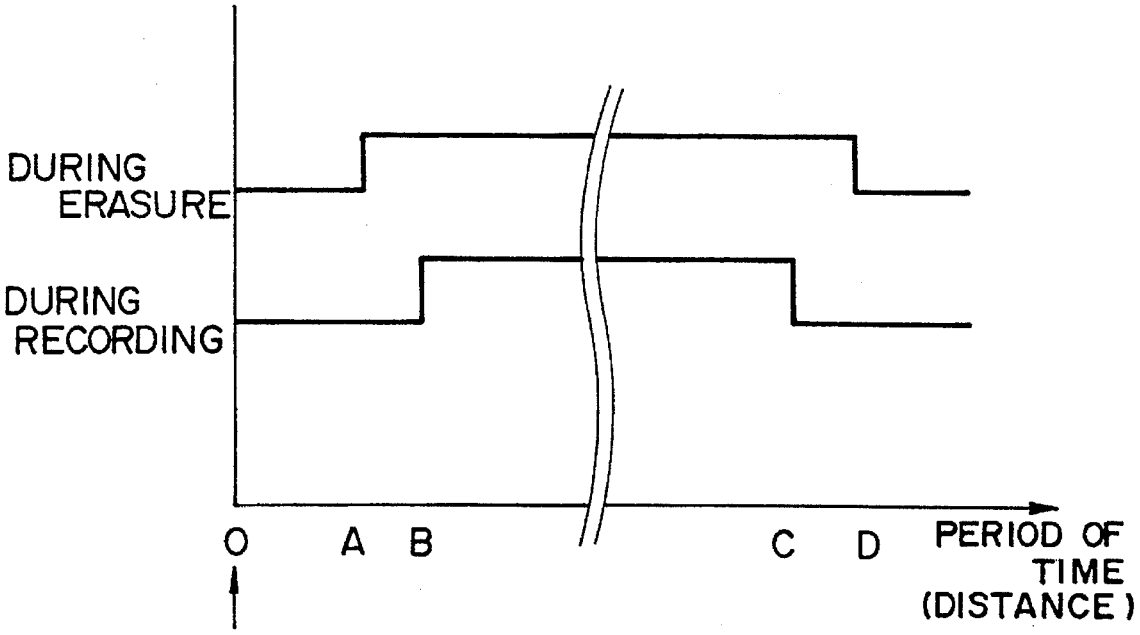
FIG. 27 shows the relationship between a heating period for the recording and another heating period for the erasing in the recording and erasing system of FIG. 26.

To prevent an insufficient erasure at the leading or trailing edge of the recording medium, the area to be erased starts at a position in front of the head of the image and terminates at a position beyond the end of the recorded image. Referring to FIGS. 26 and 27, the recording and erasing system of this embodiment comprises the thermoreversible recording medium 1, roller 2, thermal head 3, CPU 10, and a sensor 31 for detecting the leading edge of the recording medium 1. In operation, when the recording medium i is in the shape of a card (FIG. 25), the leading edge of the card is set to "0". To erase the image, the recording medium is heated at the timing A. To record the image, the recording medium is heated at the timing B. Then, the heating is finished at the timing D in the former case. Conversely, the heating is finished at the timing C to record the image. The relationships of these timings is $0 \leqq A < B < C < D$. When the recording medium 1 is loaded into the recording and erasing system in the direction shown by an arrow, the sensor 31 detects the leading edge of the recording medium 1, and notifies this to the CPU 10. At the timing B, the CPU 10 commands the control unit 5 to heat the thermal head 3 until the timing C. At the timing C, the CPU 10 instructs to stop heating the thermal head 3. To erase the image, the recording medium 1 is loaded into the recording and erasing system. Detecting the leading edge of the recording medium 1, the sensor 31 notifies this to the CPU 10. At the timing A, the CPU 10 commands the control unit 5 to heat the thermal head 3, which is heated until the timing D. In this case, heating is controlled based on a period of time or a position after the detection of the leading edge of the recording medium, or a rotational extent of the motor.

In this embodiment, the thermal head 3 is used for both the recording and erasing processes. Alternatively, two heating units may be discretely used for the recording and erasing processes. Further, a heat roller may be used as a heating means for the erasing process. In the latter case, the heat roller may be continuously kept heated within the erasing temperature.

EMBODIMENT 7

Figure 28:
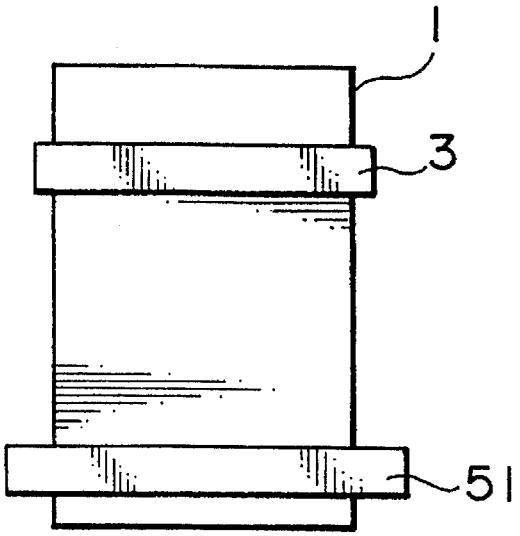
FIG. 28 shows the relationship between a recording means and an erasing means.
Figure 29:
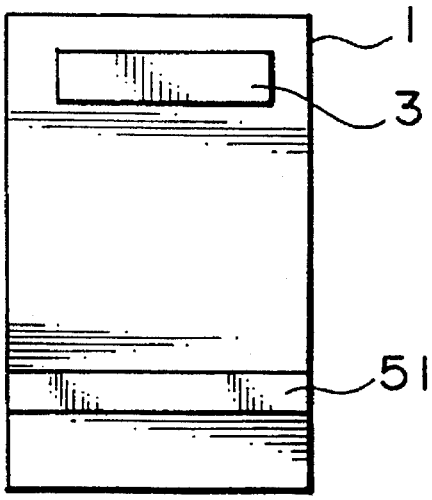
FIG. 29 is a view similar to FIG. 28.

In this embodiment, the recording and erasing system is characterized in that the width of the erasing unit is larger than the width or maximum recording width of the recording medium, and that heating units are discretely provided for the recording and erasing processes. For instance, FIGS. 28 and 29 show the relationship between the thermal heads 3 for the recording and the heat rollers 51 for the erasing process, respectively. When the recording area of the thermal head 3 is wider than the erasing area of the heat roller 51, a remarkably wide area might be left insufficiently erased. This means that the recording medium is not reusable. The erasing units whose erasing areas are wider than the recording medium can assure sufficient erasure of the image therefrom. When the thermal head 3 has the recording width which is smaller than its own length, the erasing unit should have a width larger than the recording width. Here, the term "width of the erasing unit" represents a width of the recording medium which can be heated by the erasing unit.

The foregoing description mainly relates to the relationship between the thermal head 3 and the heat roller 51. The recording and erasing processes can be effectively carried out by separate thermal heads 3 for the recording and erasing processes.

The foregoing embodiments may be used in combination.

EMBODIMENT 8

This embodiment relates to a device for obscuring a residual image which is left on the recording medium when the dye in the recording layer is not completely reversible.

Figure 30:
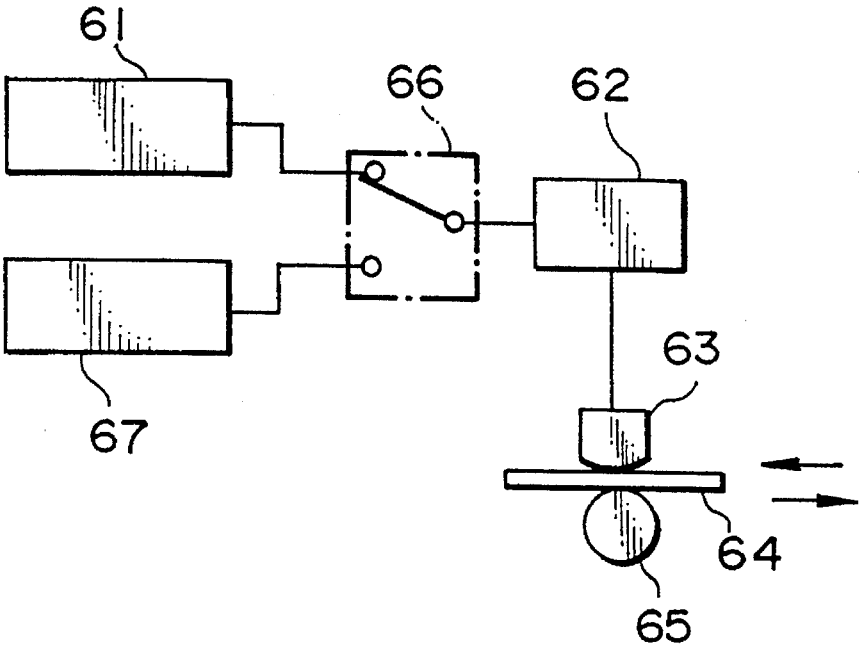
FIG. 30 shows the configuration of a recording and erasing system according to another embodiment.

Referring to FIG. 30, an image is input from an external data input unit 61 such as a keyboard. A recording control unit 62 controls a heating unit 63 for heating the heating elements associated with an image to be recorded. In this case, the recording medium 64 is heated above the temperature $t_2$ (called "high-temperature heating"), and develops the image at the heated portions thereof. As the recording medium 64 is fed by the roller 65, the heating unit 63 heats heating elements according to the image to be recorded, under control of the recording control unit 62, so that the image is recorded on the recording medium.

To erase the recorded image, a background pattern of the image is recorded first of all. Then, the erasing process will be initiated.

The background pattern comprises characters, symbols and so on, which preferably makes the main images unidentifiable.

First of all, a switch 66 is operated to connect a background pattern generating unit 67 to the recording control unit 62, which controls the heating unit 63 according to the background pattern. The heating unit 63 performs the high-temperature heating so as to record the background pattern over the entire area of the recording medium 64 which is fed by a roller 5. Thus, the main image which is already present on the recording medium is merged into the background pattern and becomes indistinct. This is because the background patterns has substantially the same color and density as the main image.

Then, the heating unit 63 heats the whole area of the recording medium 64 to the temperature higher than $t_1$ but below $t_2$ (called "low temperature heating"). Both the main image and the background pattern undergo the erasing process. The main image and the background patterns arc not always erased completely, and may be vaguely left on the recording medium as mentioned above. Thus, the residual background pattern makes the main image indistinct. Therefore, when another main image is recorded on the recording medium, it can be clearly distinguished from the existing blur image.

As described so far, it is possible to make the existing image indistinct so that the recording medium which is not always free from previous image may be reused in the recording and erasing system of the invention.

In this embodiment, the background pattern is formed over the entire area of the recording medium. Alternatively, it is possible to record the background pattern on only a limited area of the recording medium that repeatedly undergoes the recording process.

EMBODIMENT 9

This embodiment also relates to a recording and erasing system for making a residual image indistinct similarly to the system of the embodiment 8.

Figure 31:
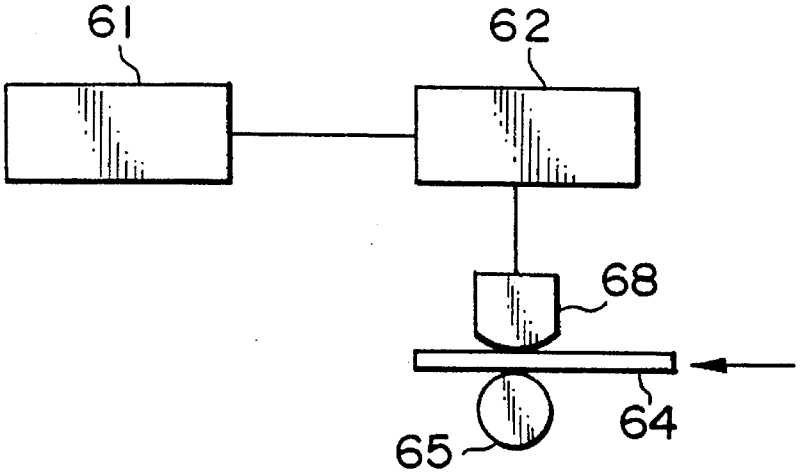
FIG. 31 shows the configuration of a recording and erasing system according to a still another embodiment.

The configuration of this recording and erasing system is shown in FIG. 31. The recording and erasing system does not include the background pattern generator 67, but has a heating unit 68 which can control quantities of energy applied to respective heating elements associated with an image to be recorded.

Figure 32A:
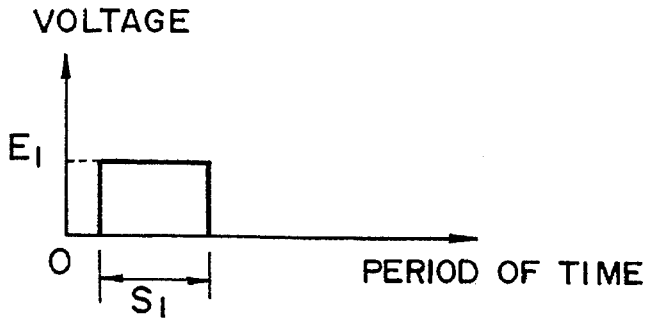
FIG. 32(A) shows a first example of heat control in the recording and erasing system of FIG. 31.
Figure 32B:
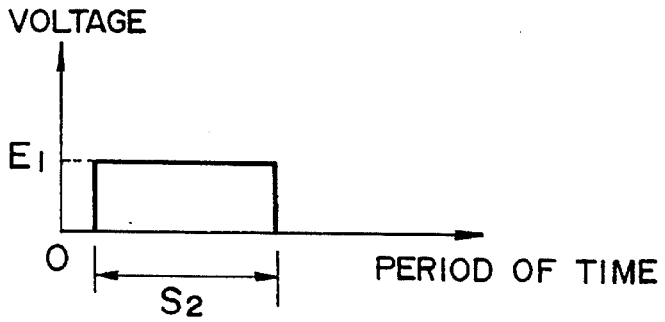
FIG. 32(B) shows a second example of heat control in the recording and erasing system of FIG. 31.

In this embodiment, the heating elements associated with the image are subject to the high temperature heating while the heating elements not associated the image are subject to the low temperature heating. The heating elements not associated with the recording are thermally controlled as shown in FIG. 32(A). The preset voltage $E_1$ is applied to these heating elements for the period of time $s_1$, which is determined so that the recording medium is heated to a temperature which is above $t_1$ but below $t_2$. Referring to FIG. 32(B), the preset voltage $E_1$ is applied to the heating elements associated with the recording for the period of time $s_2$ which is longer than $s_1$. The period of time $s_2$ is set so that the recording medium is heated to a temperature above $t_2$.

The heating elements not associated with the recording are heated to the low temperature so as to erase the area surrounding the main image. Thus, there is no problem of a residual image resulting from the previous recording process. Thermal control of the individual heating elements allows both the recording and erasing operations to be carried out in one heating process.

Figure 33A:
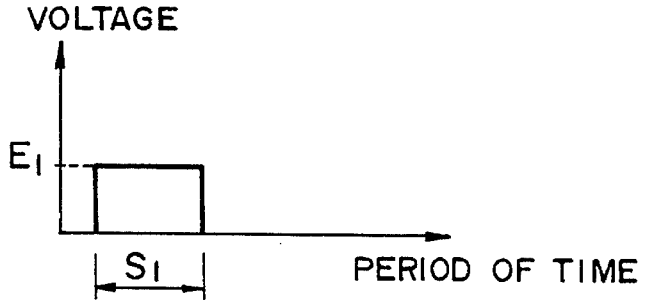
FIG. 33(A) shows a third example of heat control in the recording and erasing system of FIG. 31.
Figure 33B:
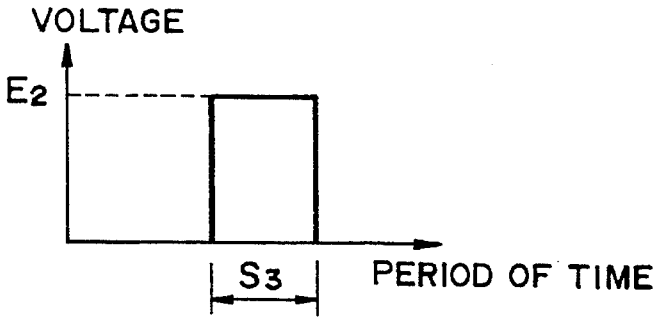
FIG. 33(B) shows a fourth example of heat control in the recording and erasing system of FIG. 31.

In this embodiment, the temperatures of the recording medium are controlled by adjusting the heating time thereof. Alternatively, it is also possible to control the temperatures of the recording medium by adjusting voltages to be supplied to the heating elements as shown in FIGS. 33(A) and 33(B). FIG. 33(A) is a view similar to FIG. 32(A). The heating elements not associated with the recording have the voltage $E_1$ applied for the period of time $S_1$. The heating elements associated with the recording have the voltage $E_2$ (larger than $E_1$) applied for the period of time $S_3$, which is set so that the recording medium is heated to a temperature above $t_2$. The higher the voltage, the shorter the period of time $S_3$.

Figure 34A:
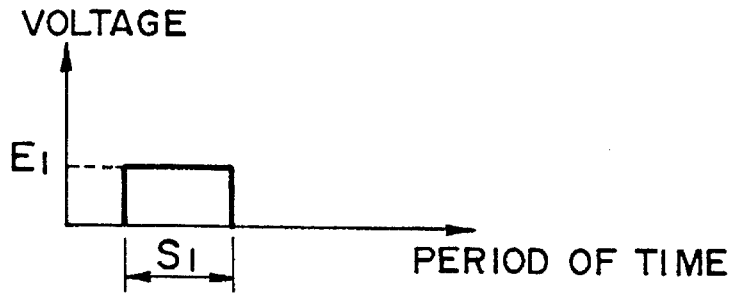
FIG. 34(A) shows a fifth example of heat control in the recording and erasing system of FIG. 31.
Figure 34B:
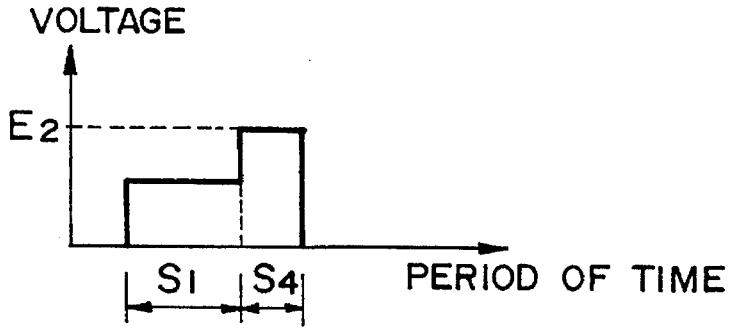
FIG. 34(B) shows a sixth example of heat control in the recording and erasing system of FIG. 31.

It is also possible to apply the voltage $E_1$ to both the heating elements for the erasing (shown in FIG. 34(A)) and those for the recording (FIG. 34(B)) for the period of time $S_1$. Then, the voltage $E_2$ is applied for the period of time $S_4$ only to the heating elements for the recording. In this case, it is possible to reduce the heating period per heating element compared with the methods shown in FIGS. 32 and 33.

In the embodiments 8 and 9, the image is recorded by applying the large energy to the recording medium. Then, the recorded image is erased by applying the small energy to the recording medium. Therefore, the main image will be recorded on the recording medium in a manner such that it is visible in a different color on the base color of the recording medium.

The image can be also recorded in the following manners.

(1) The recording medium is subject to the high temperature heating at areas not associated with the image, so that these heated areas will be blackened and the image will be visible in a base color. The recorded image will be erased by the low temperature heating.

(2) The entire area of the recording medium is subject to the high temperature heating prior to the recording so that it may be blackened. Then, the recording medium undergoes the low temperature heating so to form an image thereon in the base color. High temperature energy is applied to the recording medium to erase the image.

(3) The entire area of the recording medium undergoes the high temperature heating prior to the recording. Then, the recording medium is subject to the low temperature heating so as to erase the areas except for the image. In other words, the erased area will be in the base color. To erase the entire image, high temperature energy will be applied to the recording medium.

In any of these three methods, it is also possible to make previous Images unidentifiable by recording the background pattern on the recording medium, or by applying energy to the recording medium at areas which are not associated with the image to be recorded.

In the foregoing embodiments, the thermal head 3 is concurrently used for the recording and the erasing. Alternatively, it is possible to provide a recording-only unit and an erasing-only unit. Further, two thermal heads may be provided for the recording and the erasing in the recording and erasing system. This arrangement is also effective.

EMBODIMENT 10

In this embodiment, the recording and erasing system includes a means for entering the number of times of recording on the recording medium. The user can estimate how much the recording medium is aged, thereby preventing use of an old and degraded recording medium.

Figure 35:
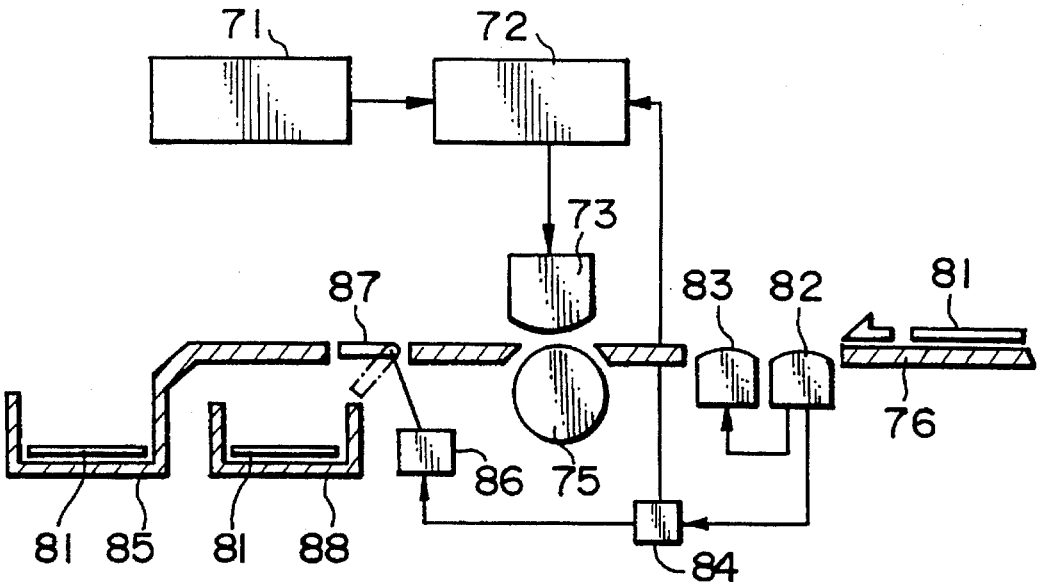
FIG. 35 shows the configuration of a recording and erasing system according to a further embodiment.

Referring to FIG. 35, an external data input unit 71 includes a keyboard. Based on the input data, a recording control unit 72 controls a thermal head 73 so as to heat heating elements associated with the image to be recorded. In this case, the recording medium 81 is heated to the temperature above $t_2$ so that the image is developed thereon. Under the control of the control unit 72, the thermal head 73 heats the recording medium 81 which is gradually advanced on a guide 76 by a platen roller 75, so that the image will be formed on the recording medium 81. To erase the recorded image, the thermal head 73 is controlled to heat the image carrying portion of the recording medium or the entire area of the recording medium 81 to the temperature above $t_1$ but below $t_2$.

The feature of this embodiment is that the recording medium 81 has a magnetic recorder, which records the number of times of use of the recording and erasing system. Specifically, when the recording medium 81 is loaded in the recording and erasing system, a magnetic reading head 82 reads the number of times (n) the recording medium has been used. Then, a magnetic recording head 83 writes a new number of times (n+1). Next, a checking unit 84 compares the number of reusable times (N) of the recording medium with the current number of times (n) so as to know whether the recording medium is still usable. The number of times (N) is stored in the checking unit 84. When (n) is smaller than (N), the recording medium 83 can be used for the recording and erasing as described above. Then, the recording medium will be conveyed to a receiver 85 for taking in a usable recording medium. Conversely, when (n) is larger than (N), the recording medium 81 is determined to be unusable. This is notified to the thermal head control unit 72, so that the recording medium is subject only to the erasing. A separator 86 (?) is also notified that the recording medium is not usable, and a switch guide 87 is operated to a position shown by a dotted line so that the recording medium 81 will be routed to a receiver 88.

Alternatively, the recording and erasing system may be configured as shown in FIG. 34 by removing the mechanism for separating the usable recording medium and unusable recording medium. Furthermore, the checking unit 84 may be dispensed with when recording only the number of times the recording medium has been used. A special determining unit nay be provided to check the current number of times of use.

The foregoing receiver for the usable recording mediums will be necessary when collecting parking tickets, for example. In this case, when (n) is smaller than (N), the thermal head 73 performs the erasing, and the recording if necessary, and the recording medium will be routed to the recording medium receiver. Conversely, when (n) is larger than (N), the recording medium will be collected in the receiver 88 for unusable recording media.

Figure 36:
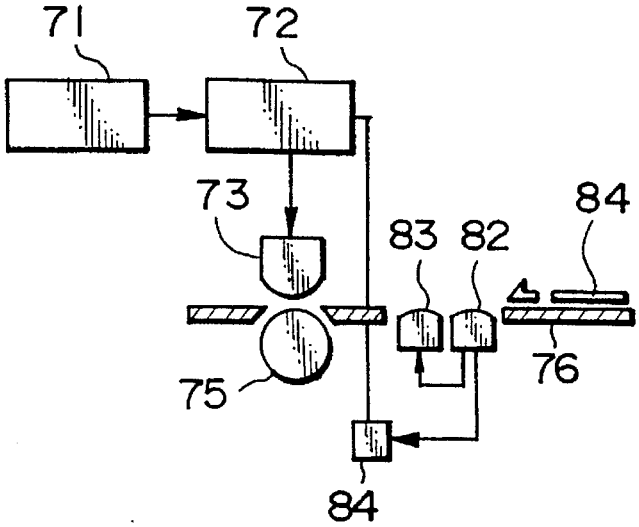
FIG. 36 shows the configuration of a recording and erasing system according to another embodiment.

When the recording medium such as a prepaid card is returned to the user, no unit will be required for separating the usable or unusable cards. In this case, when the recording medium 81 is loaded into the recording and erasing system, the magnetic reading head 82 reads the current number of times (n) of the recording medium 81. Then, the magnetic recording head 83 writes a current number of times (n+1) of use. The checking unit 84 compares (n) with (N) so as to recognize whether the recording medium is still usable. (N) has been stored in the checking unit 84. When (n) is smaller than (N), the recording medium 81 is subject to the recording and erasing by the thermal head 73, and is returned to the guide 76 (shown at the right side in FIG. 36). Conversely, when (n) is larger than (N), the recording medium 81 will be directly returned to the guide 76.

In this embodiment, it is also possible to write the current number of times (n) of use in the recording and erasing system, and the recording medium will be checked with respect to its usability by a separate judging unit.

Thus, the usable recording mediums and unusable recording mediums will be segregated. Unusable recording medium will be subject only to the erasing as described above, so that their contents will not be open to the public and abused. When such a measure is not required, no erasing will be performed on the unusable recording mediums.

EMBODIMENT 11

Figure 37:
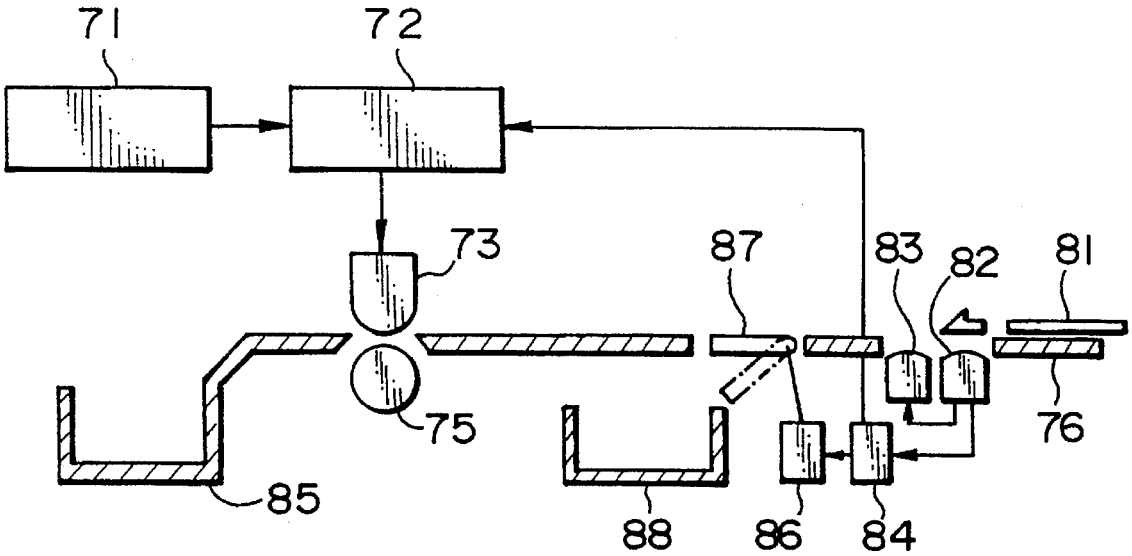
FIG. 37 shows the configuration of a recording and erasing system according to a further embodiment.

FIG. 37 shows the configuration of a recording and erasing system according to an eleventh embodiment. In this embodiment, the number of times the recording medium has been used is recorded.

The unusable recording medium receiver 18 is positioned between the thermal head 3 and a slit where the medium is loaded into the recording and erasing system. The remaining units and components are the same as those shown in FIG. 35, and will not be described in detail here. In this embodiment, the unusable recording mediums will be retrieved without coming into contact with the thermal head, so that the thermal head will be kept from being stained.

EMBODIMENT 12

The number of times the recording medium has been used is also recorded in this embodiment.

The recording and erasing system is similar to that shown in FIG. 34 except for the unit which identifies unusable recording mediums. When the checking unit 84 detects that (n) is larger than (N), the thermal head control unit 2 records symbols or a message on the surface of the recording medium 11 so as to indicate that the recording medium is unusable. For instance, a letter "X" or "Unusable" is written over the entire surface of the recording medium for this purpose. The unusable recording mediums will be retrieved inside the recording and erasing system, or returned to the user via the loading slit.

EMBODIMENT 13

The number of times the recording medium has been used is also recorded in this embodiment.

The configuration of the recording and erasing system is similar to that shown in FIG. 35 except for the usable recording medium receiver 85, which is replaced by a feeder 90 for the reusable recording mediums. A usable recording medium or a new recording medium will be returned to the user via the feeder 90.

Figure 39:
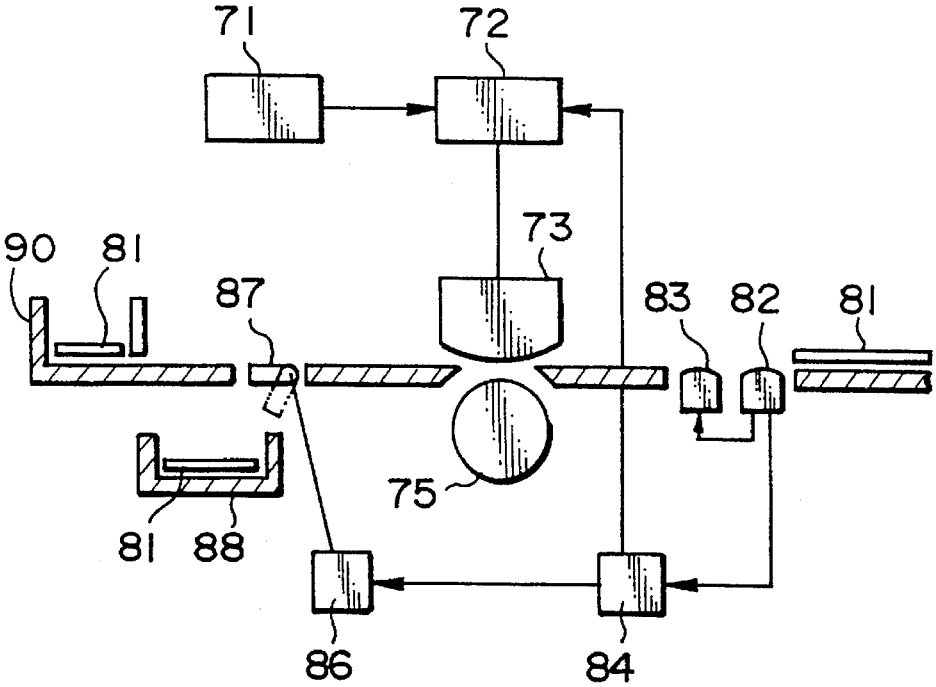
FIG. 39 shows the configuration of a recording and erasing system according to a further embodiment.
Figure 40:
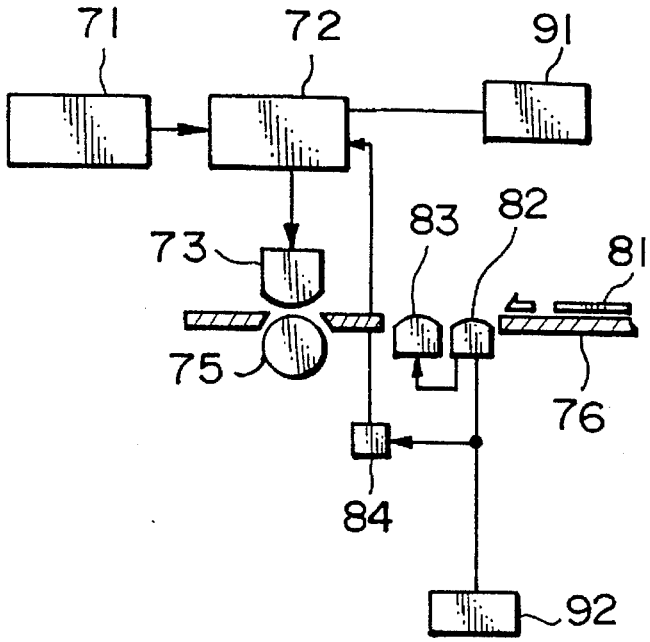
FIG. 40 shows the configuration of a recording and erasing system according to a further embodiment.
Figure 41:
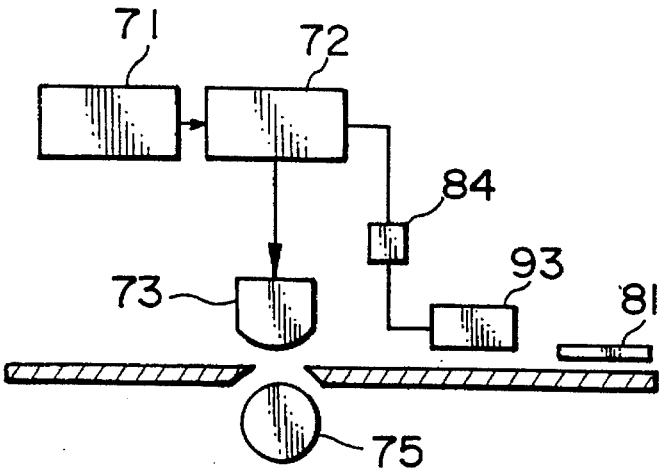
FIG. 41 shows the configuration of a recording and erasing system according to a still further embodiment.

In operation, the recording medium is loaded into the recording and erasing system as shown at the right side in FIG. 39. The magnetic reading head 82 reads the number of times of use and other data (e.g. the remaining number of usable times). The current number of times of use is sent to the checking unit 84, and is compared with the number of reusable times (N). When the recording medium 81 is found to be reusable, it is subject to the erasing by the thermal head 73. Then, the platen roller 75 is reversely rotated to heat the recording medium 81 by the thermal head 73, so that an image is recorded thereon. The magnetic writing head 83 writes the number of times of use (n+1) on the recording medium, which will be returned to the user.

Conversely, when the recording medium 81 is found to be unusable, the switch guide 87 is set to a lower side so as to convey the recording medium 81 to its receiver 88. Then, a usable recording medium 81 is fed from the feeder 90 so as to record an image thereon by the thermal head 73. The magnetic recording head 83 increments the number of times of use by one. Then, the recording medium 81 will be discharged via the loading slit. The feeder 90 may supply either new or usable recording mediums 81. In the foregoing description, the recording medium 81 is supposed to be loaded into the recording and erasing system via the slit shown at the right side in FIG. 39. When the user does not have the recording medium 81, a recording medium which carries data on transactions of an operation panel (not shown) recorded by the thermal head 73 and the data recorded by the magnetic recording head 83 will be supplied to the user.

EMBODIMENT 14

The recording and erasing system is similar to any of those shown in FIGS. 35 to 39, and includes a display 91 and a data memory 92. Sometimes, either the display 91 or the data memory 92 may suffice. The display 91 comprises display elements such as LEDs, a crystal quartz display, or seven segments.

In operation, a recording medium is loaded into the recording and erasing system. The magnetic reading head 82 reads the number of times of use and other necessary data (e.g. current balance) from the recording medium. The data on the number of times of use are transmitted to the checking unit 84, and are compared with the number of times of reuse (N). The comparison results are indicated on the display 91, so that the user can easily know whether or not the recording medium is usable. The contents of the reading head 92, i.e. the current number of times of use or the number of remaining usable times, can be indicated on the display 91.

The data memory 92 is capable of storing the data recorded on the recording medium. The data memory 92 is used to reproduce the stored data on a new recording medium when the recording medium in use is found to be unusable. When the recording medium is used up but reusable, it will be repeatedly used with the data reproduced by the data memory 92. In the former case, the data memory 92 stores the data except for the number of times of use which are on the recording medium. Therefore, the contents of the data memory 92 are reproduced on a new recording medium which is produced in the recording and erasing system or which is loaded into the recording and erasing system by the user.

It will be more convenient to the user if instructions are given on the display 91 as for loading of a new recording medium and so on.

In the embodiments 10 to 13, the number of times of use of the recording medium is magnetically recorded on the recording medium. Alternatively, the data can be stored by other means. For instance, the number of times of use may be digitally recorded on the recording medium by the thermal head 73. The digital data can be read by an optical reader 93. Alternatively, the recording medium will be perforated based on the number of times of use. Then, the perforations will be read by a suitable means. Alternatively, a battery and a memory are used to store and read the data on the recording medium without providing a magnetic layer thereon. In any case, it is important that data such as the number of times of use can be stored, read and rewritten.

In the foregoing embodiment, the thermal head 73 concurrently performs the recording and erasing. Alternatively, a recording-only unit and an erasing-only unit may be separately provided. Further, a recording thermal head and an erasing thermal head may be separately provided. This arrangement is also effective.

Heating means such as a heat roller, a surface heating resistor (??) and a laser beam source may also be used effectively for the erasing process.??

The number of times of use may be read and written only at the time of recording or erasing an image, or concurrently at the time of recording and erasing. For instance, the number of times of use may be read when erasing a recorded image, and written on the recording medium when recording an image. In this embodiment, although the magnetic heads 82 and 83 are separately used for the reading and recording, one magnetic head may be used for both the reading and recording. In the foregoing description, the term "recording" also implies "storing data".

Figure 38:
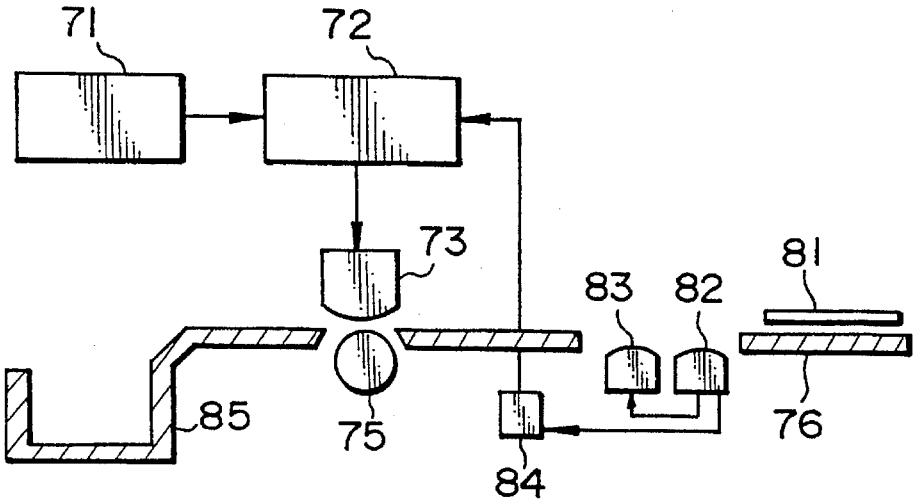
FIG. 38 shows the configuration of a recording and erasing system according to a further embodiment.

In the embodiment shown in FIG. 35, the recording medium on which the message "Unusable" is written on the entire surface thereof will be conveyed to the receiver 38 as in the embodiment shown in FIG. 38. The positional relationship between the thermal head 73 and the magnetic heads is not limited to the foregoing ones but can be modified as desired.

As described so far, it is possible to record the number of times of use of the recording medium, so that usable, used-up and unusable recording media can be easily identified. Therefore, it is possible to prevent troubles related to unusable recording media. Further, the user will be relieved from the troublesome job of checking whether or not the recording medium is still usable.

The material of the recording medium is not limited to particular ones, but may be of materials such as organic compounds with low moleculars, dyes, high polymers refined by the phase-separation, crystalline high polymers refined by the phase-change, high polymeric liquid crystalys refined by the phase-transformation, thermochromics, polymer blends, and so on.

INDUSTRIAL APPLICABILITY

The recording medium of the present invention is applicable as a parking card, a prepaid card, a commuter ticket and so forth. Repeated use of such cards is very effective in the conservation of natural resources. Further, contents of previous recording will not be revealed when the recording medium is reused.

What is claimed is:

1. A recording and erasing system for repeatedly recording and erasing an image which comprises:

a thermoreversible recording medium;

a heating element for providing predetermined quantities of energy to the recording medium; and a controller for varying a quantity of energy provided to the heating element to provide the heating element with an ability to both record and erase an image on the recording medium, wherein the predetermined quantities of energy are applied to the heating element as the recording medium passes the heating element, and further wherein the controller varies the predetermined quantities of energy so that the heating element applies a greater quantity of energy to a leading edge of the recording medium than to other areas thereof when an image on the recording medium is to be erased.

2. A recording and erasing system as in claim 1, wherein the controller is constructed and arranged to vary a quantity of energy provided to portions of the recording medium onto which an image is to be recorded.

3. A recording and erasing system as in claim 1, wherein the controller is constructed and arranged to heat a first area of the medium when erasing an image and a second area of the recording medium when recording an image, the first area being larger than the second area.

4. A recording and erasing system as in claim 3 wherein the controller heats a first area on the recording medium when erasing an image and a second area when recording an image, the first area being wider than the second area.

5. A recording and erasing system for repeatedly recording and erasing images as in claim 1, wherein the heating element is constructed and arranged to apply a first quantity of energy to an area on the recording medium when an image is to be erased and to simultaneously apply a second quantity of energy to an area on the recording medium where an image is to be recorded so that the system is capable of recording and erasing the image on different portions of the thermoreversible recording medium simultaneously.

6. A recording and erasing system as in claim 1, wherein the controller supplies a voltage to a first line of the recording medium that is from about 1.1 to about 1.5 times larger than a voltage supplied to a subsequent line of the recording medium.

7. A recording and erasing system as in claim 1, wherein the controller supplies a voltage having alternating pulse-widths.

8. A recording and erasing system as in claim 1, wherein the controller supplies a voltage which depends on a line of the recording medium.

9. A recording and erasing system as in claim 1, wherein the controller further includes background generating means for generating a background pattern.

10. A recording and erasing system as in claim 1, wherein the controller is capable of varying a voltage pulsewidth.

11. A recording and erasing system as in claim 1, wherein the controller is capable of varying a voltage pulse amplitude.

12. A recording and erasing system for repeatedly recording and erasing an image, comprising:

a thermoreversible recording medium;

a heating element for applying predetermined quantities of energy to desired areas of the recording medium, wherein the recording medium includes a portion for recording a value corresponding to a number of times the recording medium has been recorded and erased, a checking unit for checking whether the recording medium is usable based upon the recorded number of times of use and a separator for segregating usable and unusable recording media.

13. A recording and erasing system for repeatedly recording and erasing an image, comprising:

a thermoreversible recording medium;

a heating element for applying predetermined quantities of energy to desired areas of the recording medium, wherein the recording medium includes a portion for recording a value corresponding to a number of times the recording medium has been recorded and erased, a checking unit for checking whether the recording medium is usable based upon the recorded number of times of use and a writing unit for labeling the recording medium as unusable if the checking unit determines the recording medium is unusable based upon the recorded number of times of use.

14. A recording and erasing system for repeatedly recording and erasing an image, comprising;

a thermoreversible recording medium;

a heating element for applying predetermined quantities of energy to desired areas of the recording medium, wherein the recording medium includes a portion for recording a value corresponding to a number of times the recording medium has been recorded and erased, a checking unit for checking whether the recording medium is usable based upon the recorded number of times of use and a feeder for feeding new recording medium if the checking unit determines that the recording medium being checked is unusable.

15. A recording and erasing system for repeatedly recording and erasing an image, comprising:

a thermoreversible recording medium;

a heating element for applying predetermined quantities of energy to desired areas of the recording medium, wherein the recording medium includes a portion for recording a value corresponding to a number of times the recording medium has been recorded and erased and a data memory for storing data recorded on the recording medium.

* * * * *